US012419389B2

(12) United States Patent
Abel et al.

(10) Patent No.: US 12,419,389 B2
(45) Date of Patent: Sep. 23, 2025

(54) LACING LOCKDOWN SYSTEM

(71) Applicant: adidas AG, Herzogenaurach (DE)

(72) Inventors: Rohan Abel, Nuremberg (DE); Ninh An Nguyen, Ho Chi Minh (VN)

(73) Assignee: adidas AG, Herzogenaurach (DE)

( * ) Notice: Subject to any disclaimer, the term of this patent is extended or adjusted under 35 U.S.C. 154(b) by 111 days.

(21) Appl. No.: 17/514,166

(22) Filed: Oct. 29, 2021

(65) Prior Publication Data

US 2022/0132996 A1 May 5, 2022

(30) Foreign Application Priority Data

Oct. 30, 2020 (DE) ..... 10 2020 213 682.3

(51) Int. Cl.
*A43C 7/06* (2006.01)

(52) U.S. Cl.
CPC ..... *A43C 7/06* (2013.01)

(58) Field of Classification Search
CPC .. A43C 1/00; A43C 1/003; A43C 1/02; A43C 1/04; A43C 1/06; A43C 5/00; A43C 7/06; A43C 11/00; A43C 11/002; A43C 11/004; A43C 11/008; A43C 11/16; A43C 11/14; A43C 11/18; A43C 11/20; A43C 11/22; A43B 23/26
See application file for complete search history.

(56) References Cited

U.S. PATENT DOCUMENTS 1,663,221 A * 3/1928 Scroggins ..... A43B 5/025 36/89
5,271,130 A * 12/1993 Batra ..... A43C 1/04 24/714.8
5,379,529 A * 1/1995 Smith ..... A43C 11/20 36/50.1
5,463,822 A * 11/1995 Miller ..... A43C 11/00 36/50.1
5,564,203 A * 10/1996 Morris ..... A43B 23/22 36/50.1
5,909,946 A * 6/1999 Okajima ..... A43C 1/04 36/50.1
6,467,193 B1 * 10/2002 Okajima ..... A43B 5/0405 36/55
7,490,417 B2 * 2/2009 Petrie ..... A43C 11/20 36/170

(Continued)

FOREIGN PATENT DOCUMENTS

EP 2931076 B1 5/2018

OTHER PUBLICATIONS

First Office Action for German Application No. 10 2020 213 682.3, dated Jul. 1, 2021, 4 Pages.

*Primary Examiner* — Uyen T Nguyen
(74) *Attorney, Agent, or Firm* — Brooks Kushman P.C.

(57) ABSTRACT

The present invention relates to a lacing system for tightening a shoe upper, comprising: at least one strap, and a first and a second guiding element for coupling the strap to the shoe upper, wherein a first end of the strap is attached to a tongue portion of the shoe upper and a second end of the strap is configured to receive a portion of a shoelace, and wherein the first guiding element is arranged in a throat area of the shoe upper and the second guiding element is arranged in a sole area of the shoe upper opposite to the throat area.

27 Claims, 11 Drawing Sheets

(56) References Cited

U.S. PATENT DOCUMENTS

| | | | | |
|---|---|---|---|---|
| 7,774,956 | B2 * | 8/2010 | Dua | A43B 23/0235 36/9 R |
| 8,578,632 | B2 * | 11/2013 | Bell | A43C 1/04 36/88 |
| 8,800,172 | B2 * | 8/2014 | Dua | A43B 23/0275 36/55 |
| 8,869,432 | B1 * | 10/2014 | Koo | A43B 3/08 36/51 |
| 9,737,116 | B2 * | 8/2017 | Gibb | A43C 7/00 |
| 10,588,381 | B2 * | 3/2020 | Dombrow | A43B 5/06 |
| 2004/0181972 | A1 * | 9/2004 | Csorba | A43B 23/0265 36/50.1 |
| 2005/0016032 | A1 * | 1/2005 | Cox | A43B 3/12 36/132 |
| 2006/0117607 | A1 * | 6/2006 | Pare | A43C 1/04 36/50.1 |
| 2010/0043253 | A1 * | 2/2010 | Dojan | A43B 1/0072 36/47 |
| 2014/0196316 | A1 * | 7/2014 | Follet | A43C 1/04 36/84 |
| 2015/0059206 | A1 * | 3/2015 | Lovett | A43C 11/004 12/142 R |
| 2016/0219981 | A1 * | 8/2016 | Taylor | A43B 23/24 |
| 2016/0302524 | A1 * | 10/2016 | Smith | A43B 13/12 |
| 2018/0035759 | A1 * | 2/2018 | Pollack | A43C 11/165 |
| 2018/0110295 | A1 * | 4/2018 | Dyer | A43B 23/0245 |
| 2018/0295944 | A1 * | 10/2018 | Lovett | A43C 1/04 |
| 2018/0310671 | A1 * | 11/2018 | Soderberg | A43C 11/165 |
| 2019/0208864 | A1 * | 7/2019 | Beers | A43C 11/165 |
| 2019/0307209 | A1 * | 10/2019 | Houng | A43C 11/22 |
| 2020/0390196 | A1 * | 12/2020 | Manzato | A43C 11/14 |

* cited by examiner

LACING LOCKDOWN SYSTEM

CROSS-REFERENCE TO RELATED APPLICATIONS

This application claims foreign priority benefits under 35 U.S.C. § 119(a)-(d) to German patent application number DE 10 2020 213 682.3, filed Oct. 30, 2020, which is incorporated by reference in its entirety.

TECHNICAL FIELD

The present invention relates to a lacing system for tightening a shoe upper for a sports shoe, a shoe upper for a sports shoe, a sports shoe and corresponding methods of manufacturing.

BACKGROUND

Sports shoes usually comprise an upper and a sole secured thereto. To ensure a safe fit of the sports shoe on a foot of a wearer and to prevent or at least minimize movements of the sports shoe relative to the foot of the wearer, sports shoes typically comprise a retention system.

A common type of retention system is a lacing system. The lacing system often includes a number of eyelets, arranged on opposing sides of a throat of the shoe upper. A shoelace is arranged in a cross-shaped pattern in between the two opposing sides of the throat, i.e. the shoelace is alternatingly fed through eyelets on the right and the left side of the throat, such that the opposing sides of the throat move towards each other as a result of tightening the shoelace. In this way the sports shoe is fastened relative to the foot.

A further effect of a lacing system can be seen in providing an improved power transfer from the foot of the wearer to for example a soccer ball or during running if used for athletic sports. Energy loss due to friction caused by a movement of the sports shoe relative to the foot of the wearer should be minimized.

In certain sports applications, such as mountain hiking, it is also preferable to fasten the sports shoe to the wearer's foot in order to prevent injuries, e.g., a sprain of one's ankle.

A further effect of lacing systems is that the prevention or minimization of any relative movement between the sports shoe and a foot of the wearer is temporary and can be revoked if it is desired to take the sports shoe off after its application.

EP 2 931 076 B1 relates to a retention system for footwear that can include opposed constrictors and a tensioner configured to urge the opposed constrictors toward each other in response to a tensile force applied to the tensioner and opposed first and second anchors spaced from the tensioner. A retainer can have opposed first and second retainer couplers. The first retainer coupler can operatively engage the first anchor, and the second retainer coupler can operatively engage the second anchor, such that a tensile load applied to one or both of the first and second retainer couplers urges the retainer toward one or both of the first and second anchors. Each of the first retainer coupler and the second retainer coupler can be operatively engaged with the tensioner such that a tensile load applied to the tensioner urges the first retainer coupler and the second retainer coupler into tension, and thereby urges the retainer toward one or both of the first and second anchors. The opposed constrictors can include opposed first and second eyelets positioned adjacent respective first and second opposed edges of a harness member. The opposed first and second anchors can be fixedly coupled to the footwear such that the first and the second retainer couplers are positioned inwardly of the footwear relative to a user's foot when the footwear is donned.

However, the disadvantage shared by lacing or retention systems known in the prior art is that they essentially only move the opposing throat openings together, e.g., relative to each other, and do not move the quarter sections together. Thus, all remaining parts of a shoe, except the throat openings, are not tightened as a result of tightening the retention system. Moreover, if the shoelace is untightened, e.g. inadvertently, the tongue of the shoe would undergo a movement as a result of the missing tightened shoelace and need to be rearranged prior to re-tightening of the lacing system. This requirement may in particular be disadvantageous during a sports competition where a rearrangement of the tongue and the shoelaces consumes time.

Therefore, the present invention is based on the problem of providing a lacing system for a shoe upper for a sports shoe which enhances the overall fit of the shoe upper and which allows the wearer to customize a midfoot lock based on an individual foot shape. Another advantage of the present invention is that the lacing system loses less of its tightening capability when the shoelace is untightened.

SUMMARY

According to a first aspect of the present invention, this problem is solved by a lacing system for tightening a shoe upper of a sports shoe, comprising: at least one strap and a first and a second guiding element for coupling the strap to the shoe upper, wherein a first end of the strap is attached to a tongue portion of the shoe upper and a second end of the strap is configured to receive a portion of a shoelace. Moreover, the first guiding element is arranged in a throat area of the shoe upper and the second guiding element is arranged in a sole area of the shoe upper opposite to the throat area.

This arrangement provides a pulling effect on the strap and particularly its first end thereof, originating from the second end of the strap if the shoelace is pulled or tightened. As a consequence, the first end of the strap, which attached to the tongue portion of the shoe upper, pulls the tongue portion towards the midfoot area of the shoe upper and correspondingly towards a foot of a wearer, and thus additionally tightens the foot of the wearer relative to the shoe. Besides the tongue portion being pulled downwards, essentially wrapping around the foot of the wearer, also the throat area, where the first end of the strap is attached, may be pulled towards the foot of the wearer. This may also be caused by applying a pulling force on the second end of the strap or by tightening the shoelace. Based on a pulling force applied to the second end of the strap, the extent by which the tongue portion wraps around the foot of the wearer and the tightness of the fit, may be customized and adapted to the individual shape of the foot and the momentaneous requirements. This provides an enhanced comfort for the wearer of the shoe upper.

The extent, to which the throat area of the shoe upper may be pulled towards the foot as a result of tightening the shoelace, may be adjusted by the position where the first guiding element is attached to the shoe upper. By increasing the distance between the upper-most opening of the throat area and the location for attaching the first guiding element to the throat area of the shoe upper, a floating portion of the remaining throat area may be defined. The floating portion may be located in between the location of attaching the first guiding element and the upper-most portion of the throat area. The result of the pulling effect, e.g., as a consequence of tightening the shoelace, may be mitigated in the floating portion, where the floating portion may be pulled towards the foot of the wearer to a lesser extent. The at least one strap can be made from a variety of elastic or non-elastic materials, e.g., webbings, synthetics, ropes, laces, textiles, woven materials, etc. In other words, the strap may be made from a rigid material or alternatively from a flexible and stretchable material or any other suitable material to provide sufficient tensile strength for the wrapping of the shoe upper and/or the tongue portion around the foot of the wearer.

The at least one strap may be arranged such that it is movable relative to the shoe upper. Since the strap is therefore movable independently from the shoe upper, it may wrap around the foot of the wearer, depending on the shape and the material properties of the strap. In addition, since the strap is attached to the shoe upper, it may pull the shoe upper towards the foot of the wearer, which may therefore also be adaptable to the shape of the foot of the wearer.

The at least one strap may be movable relative to the shoe upper along a longitudinal direction of the strap. Arranging the strap movable along a longitudinal direction of the strap and relative to the shoe upper may provide an optimized force transmission from the strap to the shoe upper which allows a defined pulling of the shoe upper towards the foot of the wearer when the strap is pulled, e.g. as a result of tightening the shoelace received by the second end of the strap. It may further allow an optimized wrapping of the shoe upper around the foot of the wearer as a result of the corresponding wrapping of the strap around the foot of the wearer.

The first and the second guiding element of the lacing system may be partially attached to the shoe upper. It is therefore possible that only certain portions of the first and/or the second guiding element are attached to the shoe upper. The first and the second guiding element may be attached to the shoe upper by stitching, heat-pressing, molding applications, or another other suitable manufacture procedure.

The first and/or the second guiding element may be a band element that is at least partially attached to the shoe upper and may form an opening. The at least one strap may pass through the opening. This allows the first and/or the second guiding element to form an opening such that any lateral movement of the strap, passing through the opening, may be prevented. Particularly, this arrangement ensures that a defined pulling direction of the tongue portion towards the foot is achieved when the shoelace is tightened. It may be beneficial that the strap runs straight down along an inner side of the shoe upper from the throat area to a sole area of the shoe upper, such that the longitudinal direction of the strap is substantially perpendicular to a direction from a toe area to a heel area of the shoe upper. Straight may be referred to as choosing the location for the strap such that the shortest possible distance of the strap is realized in between the throat area and the sole area.

The sole area of the shoe upper refers to an area of the shoe upper that is close to where the shoe upper is attached to a shoe sole and/or a strobel and/or a mid-sole. Accordingly, the sole area may include an edge of the shoe upper which is configured to be attached to a shoe strobel and/or the shoe sole. Alternatively or additionally, the sole area of the shoe upper may be attached to a shoe midsole. This may provide the advantage that the shoe upper, according to the present invention, may be adapted to a variety of different shoe strobels and/or soles and may thus be made applicable for a variety of sports applications. Furthermore, when the second guiding element of the lacing system is arranged in the sole area of the shoe upper and as close to the edge as possible, the segment of the strap that is guided between the first and second guiding elements can be maximized, which results in an improved pulling effect by tightening the shoe lace. With a maximized segment of the strap in close proximity to the shoe upper, a larger part of the shoe upper can be pulled towards the foot of the wearer by the tightened shoelace, which accordingly provides a more customized fit to the wearer.

The lacing system for tightening a shoe upper may further comprise an elastic element which is at least partially attached to the strap, wherein the elastic element is stretchable. The elastic element may be made of any elastic material such as an elastic textile or a synthetic material. Using an additional elastic element provides the advantage that a lock-down effect can be achieved when the tongue portion is pulled towards the foot of the wearer. When the shoelace is tightened, a tension force is applied to the elastic element which causes the elastic element to stretch in the tightened state of the shoelace. Due to a corresponding restoring force of the stretched elastic element, an additional pulling force is applied to the tongue portion and/or the throat area of the shoe upper. The amount by which the elastic element stretches depends on the material selection for the elastic element. The amount of stretch at one end of the strap is preferably up to 1.5 cm but may exceed this value in other embodiments. However, it is preferably that the strap does not reach a respective opposite side of the throat area to provide a sufficient lock-down effect according to the needs of the wearer. If the shoelace is untightened, the elastic element returns to its relaxed (i.e. unstretched) state. However, this still provides a pulling force onto the throat area and/or the tongue portion towards the foot of the wearer. Consequently, even though the shoelace is untightened, the shoe upper still provides a good fit of the shoe as compared to a shoe upper with a common lacing system according to the prior art. Therefore, the tongue portion can be provided with a lock-down effect and the wearer is not required to rearrange the tongue portion when re-tightening the shoelace.

In particular, the elastic element is arranged in the lacing system such that the elastic element is stretchable along a longitudinal direction of the strap, which preferably corresponds to the direction of the pulling force applied on the strap from the tightened shoelace.

It is possible that the elastic element is only attached to the strap and not to the shoe upper. Alternatively, the elastic may be at least partially attached to the shoe upper, which provides the advantageous effect that the elasticity and the restoring force of the elastic element can be further influenced by the shoe upper, e.g., by the length of the elastic element that is fixed to the shoe upper. A longer attachment of the elastic element to the shoe upper provides a stronger connection and thus a more pronounced restoring force, and vice versa. The elastic element can be attached to the shoe upper by, for example, stitching.

Optionally, a first attachment point of the elastic element to the strap may be closer to the throat area of the shoe upper than a second attachment point of the elastic element to the shoe upper. This allows to direct the restoring force of a stretched elastic element to act along the direction from the first attachment point towards the second attachment point of the elastic element to the shoe upper.

The length of the elastic element may be less than the distance between the first and the second guiding elements.

Accordingly, the first and the second attachment points of the elastic element to the strap can be located in a region in between the first and the second guiding elements.

The elastic element of the lacing system may be arranged between the strap and one of the guiding elements and/or between the strap and the shoe upper. In case the elastic element is arranged between the strap and one of the guiding elements, the elastic element may be formed as a tube which accommodate the strap according to one of the above-mentioned embodiments. If the guiding element is located in between the strap and the shoe upper, it may be possible to form a tube by using the second elastic element which is located in between one of the corresponding guiding elements and the strap.

The first guiding element and/or the second guiding element may further be arranged as a band element. The band element may be partially attached to the shoe upper to form an opening, and the strap and the elastic element may both pass through the opening. This arrangement ensures that a defined pulling direction of the tongue portion towards the foot is achieved when the shoelace is tightened. For example, the opening may guide the strap and the elastic element to be arranged in a direction from the throat area to the sole area of the shoe up-per. Moreover, this configuration may prevent undesired lateral movement of the strap, which may weaken the puling and tightening effect of the lacing system.

The elastic element may extend from the first guiding element to the second guiding element of the lacing system. In this case, a full length of the strap, which is arranged between the first and the second guiding elements, is accompanied by the elastic element. An increased length or a full length of the elastic element may provide a stronger restoring force to the lacing system, therefore allows a strengthened lock-down effect on the tongue portion of the shoe upper. In addition, when the strap is arranged between the full-length elastic element and the shoe upper, the elastic element may also be protected by the elastic element from abrasion.

The elastic element may have a width larger than a width of the strap, which may allow the elastic element to be formed as a tube, which contains the strap.

The first and second guiding elements may both be arranged substantially perpendicular to the longitudinal direction of the strap.

The second guiding element may be arranged along the longitudinal direction of the strap, while the first guiding element may be arranged substantially perpendicular to the longitudinal direction of the strap. In this case, the first guiding element may be a band element oriented perpendicular to the longitudinal direction of the strap and arranged in the throat area of the shoe upper, and the second guiding element may be another band element oriented along the longitudinal direction of the strap and arranged in the sole area of the shoe upper. This arrangement may provide a guiding effect with an increased stability to the strap, as the strap is guided, and limited, at two different and separate locations respectively at the first and second guiding element.

The second guiding element may be attached to the shoe upper to form a tube where the strap passes through. In this case, the guiding element may be at least partially attached to the shoe upper by stitches at the left and right edges of the guiding element such that the stitches do not fix the strap and an optional elastic element. This may prevent a lateral movement of the strap and the elastic element.

The second guiding element may also integrate with the elastic element into a one-piece multifunctional element of the lacing system. In other words, a multifunctional element of the lacing system may function as a guiding element and at the same time as an elastic element. For example, the multifunctional element may function as an elastic element at a first end thereof arranged near the throat area of the shoe upper, while functioning as a guiding element at a second end arranged near the sole area of the shoe upper. This configuration may simplify the manufacture and production of the lacing system and reduces the amount of required raw materials.

Moreover, a first end of the one-piece multifunctional element may partially be attached to the first end of the strap. A second end of the one-piece multifunctional element may be partially attached to the shoe upper in the sole area of the shoe upper. This allows for an increased restoring force and force transmission when the wearer pulls a shoelace received by the second end of the strap, as the second end of the one-piece multifunctional element is directly attached to the shoe upper. What is more, a tightening of the shoelace may pull the strap and may thus stretch the elastic element. This stretch may provide an additional tightening effect. As a result of untightening the shoelace, the one-piece multifunctional element may automatically return to its original (relaxed) position and may unwrap the foot of the wearer such that the shoe may easily be taken off.

In addition, the first end of the one-piece multifunctional element may be movable relative to the shoe upper, which may provide a function similar to an elastic element. The second end of the one-piece multifunctional element may essentially not be movable relative to the shoe upper, which may provide a function similar to a guiding element.

Particularly, the second end of the one-piece multifunction element may be arranged such that it moves significantly less than the first end of the one-piece multifunctional element. However, any relative movement of the second end of the one-piece multifunctional element may be suppressed. A movement of the first end of the one-piece multifunctional element relative to the shoe upper may provide a wrapping effect of the one-piece multifunctional element around the foot of the wearer. When a one-piece multifunctional element is used in the lacing system, it is easier and more efficient to design and control the overall performance of the lacing system, which should provide on the one hand appropriate guidance and orientation to the strap with respect to the shoe upper and on the other hand an optimized lock-down and fitting effect when the tongue portion is pulled towards the foot of a wearer via the strap.

According to the aspects of the present invention, the second end of the strap may be arranged such that it forms a loop. This allows the second end of the strap to receive a shoelace for tightening the shoe upper and for pulling the tongue portion of the shoe upper towards the foot of a wearer. In a preferred configuration, the loop is arranged in the throat area of the shoe upper.

The second end of the strap may extend from an edge of the shoe upper at the throat area. This arrangement may provide the beneficial effect that it may be easier to pass a shoelace through the second end of the strap.

The first end of the strap may be attached to the tongue portion of the shoe up-per by stitches. This may yield a permanent and fixed attachment of the strap to the tongue portion and thus allows to exert an amount of pulling force to the tongue portion which causes the tongue portion to be pulled towards the foot of the wearer and to wrapping of the tongue portion around the foot of a wearer. It may also be possible to attach the strap to the tongue portion by any other suitable technique such as gluing or welding.

The guiding element may be attached to the shoe upper by stitches. The elastic element may additionally or alternatively be attached to the shoe upper by stitches. Attaching the elastic element to the shoe upper may consequently prevent any longitudinal and any lateral movement of the elastic element relative to the shoe upper. Any remaining movements of the elastic element may then arise due to a stretching of the elastic element, e.g., by pulling the strap. Besides a single guiding element, it is also possible to attach multiple guiding elements to the shoe upper.

It is further possible that the guiding element and/or the elastic element is attached to a reinforcing layer of the shoe upper. The reinforcing layer may provide structural stiffness to the shoe upper.

The guiding element may be elastic. An elastic guiding element may provide the advantage of an additional pulling force which arises from a stretched state of the elastic element if the strap is pulled. In addition, an elastic guiding element may provide flexibility on the dimension of the opening formed by the guiding element, through which the strap passes. It becomes possible for the strap to pass through a very fit opening or a smaller opening, which provides a more delicate configuration of the lacing system. For example, the surface of the lacing system may become smoother, which provides more comfort for a wearer. Typical materials used for the guiding elements are synthetic materials, non-woven materials or common textiles such as knitted or woven fabrics.

The lacing system may further comprise a supporting layer which covers at least partially the strap and/or the guiding element. Additionally or alternatively, the supporting layer may also cover at least partially the elastic element. Providing an additional supporting layer allows for a better distribution of the forces acting on the shoe upper. The additional supporting layer may further prevent or at least decrease relative movements between the first guiding element and the second guiding element. Moreover, the supporting layer may also prevent the straps and/or the elastic elements and/or the guiding elements from rubbing on the foot of the wearer which may be perceived as uncomfortable. The supporting layer may further provide an increased stress resistance and an increased tensile strength when the shoelace and the strap are pulled and tightened.

The supporting layer may be implemented such that it is a mesh layer. Alternatively, the supporting layer can be made of any appropriate materials with de-sired properties. For example, for a sports shoe, particularly designed for lateral movements of the foot of the wearer, the supporting layer may be with a larger thickness in order to prevent any pressure points on the foot of the wearer.

The lacing system may be arranged on different areas of the shoe upper, for example, on a quarter area and/or a midfoot area of the shoe upper. As the quarter area and the midfoot area are located closest to the tongue portion of the shoe upper, the lacing system may provide an optimized effect for tightening the shoe upper and pulling the tongue portion to the foot of a wearer.

The lacing system may be arranged on either medial side or lateral side, or both sides, of the shoe upper, according to varied demands and needs. When the lacing system is provided on both medial and lateral sides of the shoe upper, it may provide a stronger tightening effect to the shoe upper. However, the weight of the shoe upper might be slightly increased accordingly.

The lacing system may be arranged on an inner side of the shoe upper which is configured to be in contact with the foot of the wearer. This provides the advantage that the lacing system is not visible and is closer to the wearer's foot, which may provide a better fit for the wearer.

Alternatively, the lacing system may also be arranged on an outer side of the shoe upper, where the strap may extend through an aperture on the shoe upper and wrap the shoe upper on the outer surface of the shoe upper. In this case, the guiding elements and the elastic elements are arranged on the outer side of the shoe upper and the strap extends from the inside to the outside of the shoe up-per. However, the attachment of the first end of the strap to the tongue portion remains unchanged. This arrangement may provide a better comfort for the wearer, and reduces the possibility to create a pressure point on the foot which may be experienced as uncomfortable by the wearer, when the strap tightening the shoe upper from the outer side and pulling the shoe upper towards the foot of the wearer.

The lacing system may comprise a plurality of straps. In this case, each of the straps may be coupled to corresponding guiding elements and/or a corresponding elastic element and/or a corresponding one-piece multifunctional element. One-piece multifunctional elements are obtained by integrating one of the corresponding second guiding elements with one of the corresponding elastic elements. The number of straps and the optional corresponding elastic elements may be four or any other suitable number.

The first guiding element and/or the second guiding element may be part of a one-piece band element which is at least partially attached to the shoe upper to form a plurality of openings. Each of the plurality of straps accordingly passes through a corresponding opening. This arrangement of one or more one-piece band element provides an increased customization functionality of the shoe up-per to the shape of the foot of the wearer, as a larger area of the shoe upper may be pulled towards the foot of the wearer as a result of tightening the shoelace.

The present invention further relates to a shoe upper, which comprises a lacing system as described herein, wherein the lacing system is arranged on a quarter area and/or a midfoot area of the shoe upper.

The present invention also relates to a shoe which comprises a sole and a shoe upper, wherein the shoe upper comprises a lacing system as described herein.

The present invention also relates to a method of manufacturing a lacing system for tightening a shoe upper. It comprises the steps of (a.) providing at least one strap and a first and a second guiding element for coupling the strap to the shoe upper, (b.) attaching a first end of the strap to a tongue portion of the shoe upper, (c.) configuring a second end of the strap to receive a portion of a shoelace, (d.) arranging the first guiding element in a throat area of the shoe upper and arranging the second guiding element in a sole area of the shoe upper opposite to the throat area.

Moreover, the present invention also relates to a method of manufacturing a shoe upper which comprises the steps of the method of manufacturing a lacing system for tightening a shoe upper as described herein and of arranging the lacing system on the shoe upper.

In addition, the present invention further relates to a method of manufacturing a shoe which comprises the manufacturing steps of (a.) providing a sole, (b.) providing a shoe upper with a lacing system manufactured as described herein, and (c.) attaching the shoe upper to the sole.

The shoe upper may be a shoe upper for a sports shoe. Preferably, the sports shoe may be a tennis shoe. While the invention is not limited to tennis shoes, its application to tennis is particularly advantageous because a tight fit of the shoe is very important as abrupt sprints and stops are very common in this kind of and similar sports.

BRIEF DESCRIPTION OF THE DRAWINGS

Aspects of the present invention will be explained in more detail with reference to the accompanying figures below. These figures show.

DETAILED DESCRIPTION

In the following, only some embodiments of the invention are described in detail. It is to be understood that these exemplary embodiments can be modified in a number of ways and combined with each other whenever compatible and that certain features may be omitted in so far as they appear dispensable.

A first aspect of the present invention relates to a lacing system for tightening a shoe upper of a sports shoe. The lacing system comprises (a.) at least one strap and (b.) a first and a second guiding element for coupling the strap to the shoe upper, wherein a first end of the strap is attached to a tongue portion of the shoe upper and a second end of the strap is configured to receive a portion of a shoe-lace. Moreover, the first guiding element is arranged in a throat area of the shoe upper and the second guiding element is arranged in a sole area of the shoe up-per opposite to the throat area.

Figure 1:
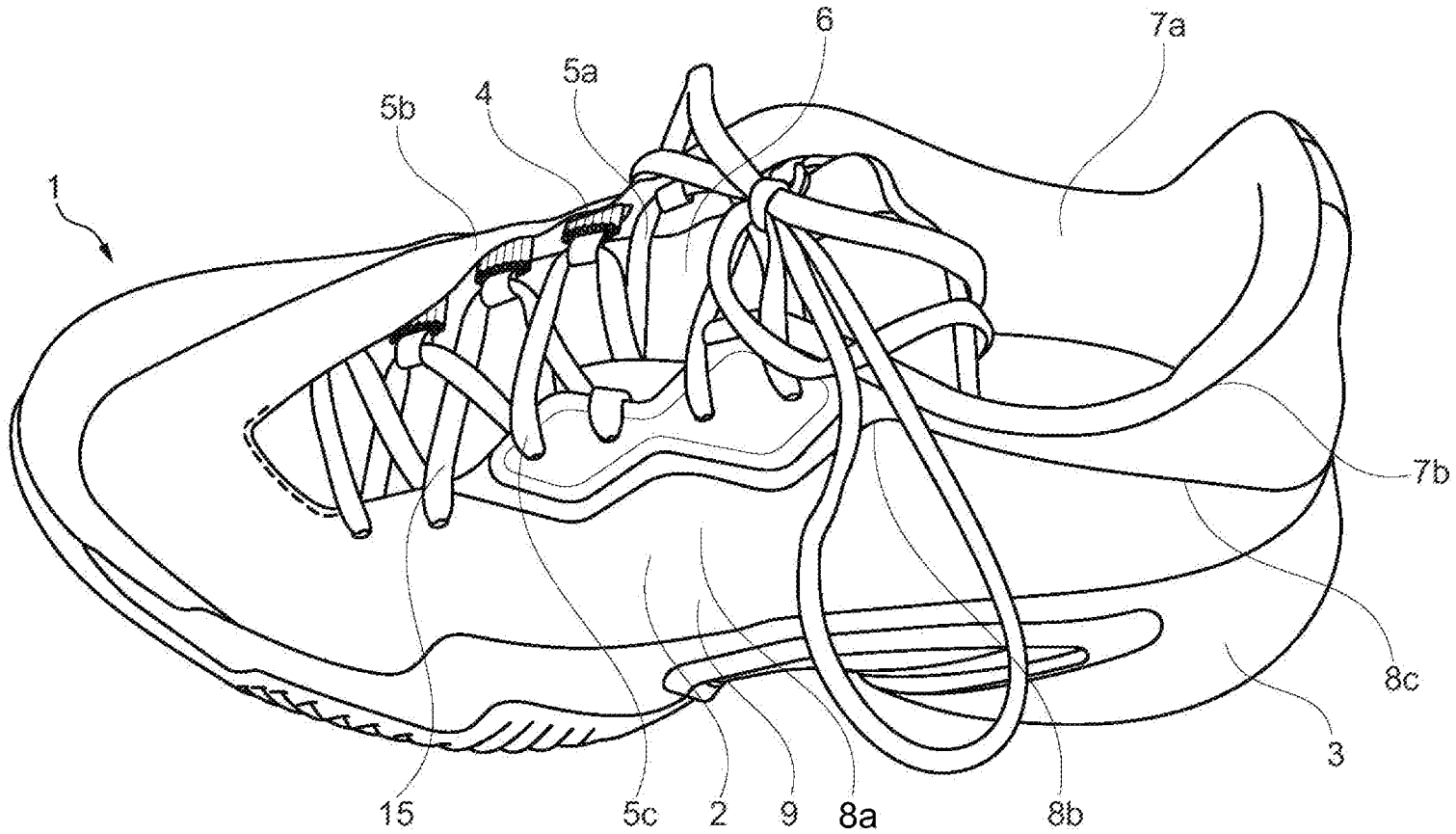
FIG. 1: an embodiment of a shoe with a lacing system according to the present invention.

FIG. 1 shows a shoe 1, in particular, a sports shoe according to the present invention. The shoe 1 comprises a shoe upper 2 which corresponds to the part of the shoe which essentially circumvents the upper side of a foot of a wearer, i.e. the instep of the foot. The bottom side of the shoe comprises a sole 3 which is fixedly attached to the shoe upper 2. This may be done by stitching, gluing, etc.

The shoe upper 2 comprises a throat area 4 which is located opposite to the sole 3. The throat area 4 is characterized in that it relates to an opening of the shoe upper 2 and in particular comprises a throat opening 5*a*. The throat opening 5*a* may be extended if the shoe upper 2 accommodates the foot of the wearer. The throat opening 5*a* may be in a widened state if the shoe upper 2 is in an untightened state and in a less widened state if the shoe upper 2 is in a tightened state. In other words, the dimension of the throat opening 5*a* may be adjusted and changed by the tightness of the shoe upper 2.

The throat area 4 of the shoe upper 2 further comprises two throat sides 5*b*, 5*c* on opposing sides of the throat opening 5*a* respectively. As a result of tightening the shoe, the two throat sides 5*b*, 5*c* next to the throat opening 5*a* move towards each other and reduce the throat opening 5*a*. Optional shoe eyelets, as a supplement to the lacing system of the current invention, may be implemented on the throat sides 5*b*, 5*c* to receive a shoelace 15.

The shoe upper 2 further comprises a tongue portion 6 which lies in between the two throat sides 5*b*, 5*c* of the throat area 4 and covers the instep of the foot of the wearer.

The shoe upper 2 further comprises an inner side 7*a*, which may be in direct contact with the foot of the wearer, and an outer side 7*b* opposite to the inner side 7*a*. The shoe upper 2 further comprises a midfoot area 8*a*, a quarter area 8*b* and a heel area 8*c*. The quarter area 8*b* is substantially located between the midfoot area 8*a* and a heel area 8*c* of the shoe upper. However, in different embodiments the midfoot area 8*a* and the quarter area 8*b* may also refer to an overlapping area of the shoe upper.

It should be noted that FIG. 1 shows the lateral side of the shoe 1 and the shoe upper 2 as an exemplary illustration. The shoe upper 2 accordingly comprises a corresponding midfoot area 8*a*, quarter area 8*b* and heel area 8*c* on the medial side thereof, which is not shown in FIG. 1. The shoe 1 and the shoe upper 2 are shown exemplarily and may vary among the various embodiments as described below.

Figure 2A:
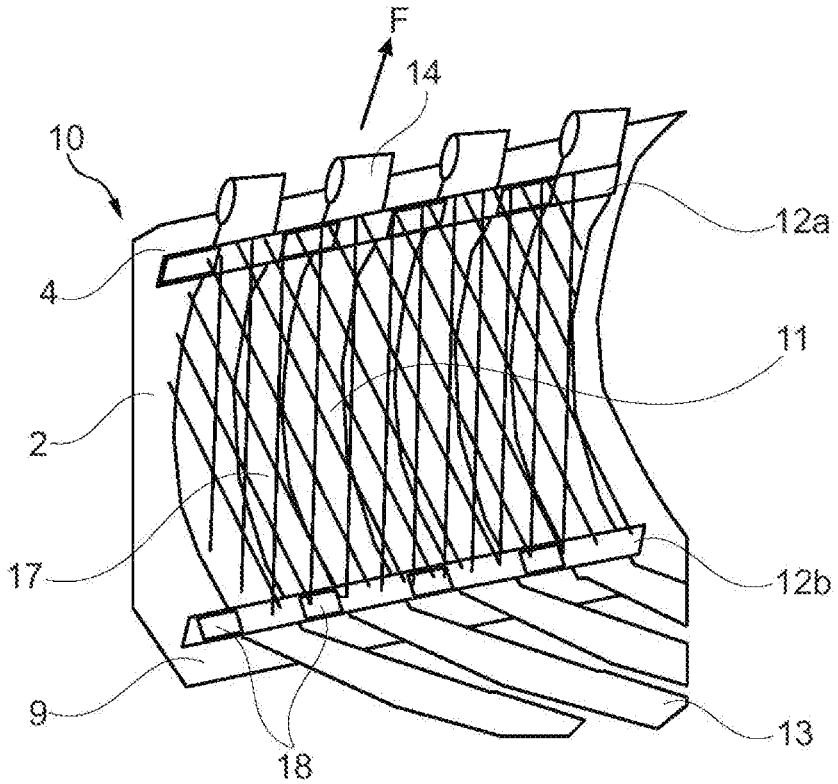
FIG. 2A-C: an illustration of a first embodiment of a lacing system for a shoe upper according to the present invention.

FIG. 2A shows an illustration of a first embodiment of a lacing system 10 for tightening a shoe upper according to the present invention. The lacing system 10 is used in combination with the shoe upper 2 as a part of the shoe 1. The lacing system 10 comprises at least one strap 11, and a first and a second guiding element 12*a*, 12*b* for coupling the strap 11 to the shoe upper 2. A first end 13 of the strap 11 is arranged near or attached to a tongue portion 6 of the shoe upper 2, which is not shown in FIG. 2A but the illustration of a tongue portion 6 in FIG. 1 is referred here. A second end 14 of the strap 11 is configured to receive a shoelace 15 (not shown in FIG. 2A). The strap 11 may be made from webbing or any other suitable material and may be made from a rigid material or alternatively from a flexible and stretchable material. Even though the exemplary description below relates to an exemplary strap 11 of the lacing system 10, it should be noted that a lacing system according to the present invention may comprise a plurality of straps 11, for example, four straps as depicted in FIG. 2A.

The first guiding element 12*a* is arranged in a throat area 4 of the shoe upper. The second guiding element 12*b* is arranged in an area opposite to the throat area 4 and referred hereafter as a sole area 9. Referring to the FIG. 1, the sole area 9 of the shoe upper is the area of the shoe upper 2 that is close to the sole 3. The sole area 9 may further include an edge of the shoe upper 2 which is configured to be attached to a shoe strobel and/or a shoe sole 3 and/or a midsole.

The guiding elements 12*a*, 12*b* are formed as band elements in this embodiment, which particularly can prevent a lateral movement of the at least one strap 11 relative to the shoe upper. The guiding elements can also be formed in any other form/shape with suitable materials, which supports the at least one strap 11 and defines the orientation of the strap with respect to the shoe upper 2.

The guiding elements 12*a*, 12*b* may be at least partially attached to the shoe upper 2, for example, at the one or more locations 18 as shown in FIG. 2A. In this embodiment, the guiding elements 12*a*, 12*b* form an opening with respect to the shoe upper 2 such that the strap 11 passes through the opening and is movable freely within the opening and relative to the shoe upper 2. Particularly, the strap 11 can therefore move along a longitudinal direction, which corresponds to a direction from the throat area 4 to the sole area 9 of the shoe upper 2. The guiding elements can be attached to the shoe upper 2 by a stitching or any other suitable technique.

When the lacing system 10 is in use together with a shoe upper 2 in a shoe 1, a shoelace (e.g. shoelace 15 as shown in FIG. 1) would be received by the second end 14 of the strap 11, for example, by passing through a loop formed at the second end 14 of the strap 11. The first end 13 of the strap 11 would be attached to a tongue portion 6 of the shoe upper 2. The segment of the strap 11 between the first end 13 and the second end 14 would be guided and oriented by the guiding elements 12*a*, 12*b*, and preferably be positioned close to the surface of the shoe upper 2.

When the wearer of the shoe intends to tighten the shoe upper 2 of the shoe 1, the wearer of the shoe would pull the shoelace up, i.e. with a force F as shown in FIG. 2A and towards a direction away from the instep of foot of the wearer. The shoelace and the pulling force F would accordingly pull the strap 11 along the same direction, resulting in the tongue portion 6 being moved down towards the instep of foot of the wearer. In addition, the pulling force F would also move the shoe upper 2 closer to the foot of the wearer at the midfoot area, i.e. wrapping the shoe upper around the foot. Therefore, the lacing system according to the pre-sent invention can provide a customized and optimized fitting effect to the foot of the wearer, where the foot can be properly covered and protected by the shoe upper and the tongue portion thereof.

Optionally, the lacing system 10 may further comprise a supporting layer 17 covering at least partially the strap 11 and/or the guiding elements 12*a*, 12*b* of the lacing system 10. The supporting layer can be a mesh layer made of mesh materials or a padding layer providing cushioning effects. The supporting layer 17 can provide a protection effect to the lacing system 10, for example, to avoid abrasion and damage to the strap 11 and/or the guiding elements 12*a*, 12*b*. In addition, the supporting layer 17 is preferably positioned between the lacing system 10 and the foot of a wearer, which can prevent undesired pressure points on the foot of the wearer and thus provide a better comfort. The supporting layer 17 may be stitched to the horizontal one or more guiding elements 12*a*, 12*b*. Alternatively, the supporting layer 17 may also be attached to the inner side of the shoe upper 2 such that the strap 11 is movable freely relative to the supporting layer 17 and the shoe upper 2.

Figure 2B:
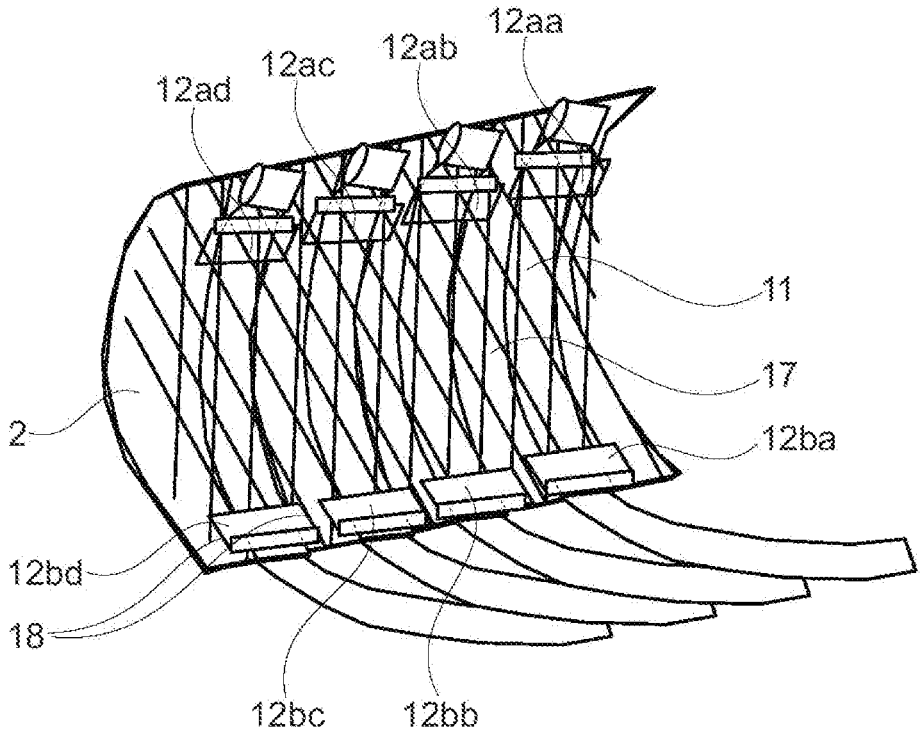

FIG. 2B shoes another embodiment of a shoe upper 2 comprising a supporting layer 17 wherein the supporting layer 17, which may be arranged for example as a mesh layer, is selectively melted onto an inner side of the shoe upper 2. Alternatively, the inner side of the shoe upper 2 may additionally be equipped with an additional reinforcement layer which may strengthen the structure of the shoe upper 2. The supporting layer 17 may alternatively be selectively melted to the additional reinforcement layer. Selectively melting the supporting layer 17 onto the inner side of the shoe upper 2 or the reinforcement layer may comprise attaching the supporting layer 17 to an area in between two adjacent straps 11. Selectively melting the supporting layer 17 onto the shoe upper or the reinforcement layer may be performed by heat pressing or any other suitable technique. Selectively melting the supporting layer 17 to the shoe upper or the reinforcement layer may provide the advantage that the strap 11 may still move freely relative to the supporting layer 17 and the shoe upper 2.

The guiding elements 12*a* and 12*b* may be arranged as respectively a single piece guiding element e.g., as band-like elements as shown in FIG. 2A. One or both of the guiding elements 12*a* and 12*b* may also be arranged as multiple pieces guiding elements 12*aa*-12*ad* and 12*ba*-12*bd* as shown in FIG. 2B respectively. This yields a dedicated guiding element for each strap 11 without any further interconnecting in between the multiple pieces guiding elements 12*aa*-12*ad* and 12*ba*-12*bd*. The multiple pieces guiding elements 12*aa*-12*ad* and 12*ba*-12*bd* may each be attached to the shoe upper 2 and/or the supporting layer 17 at two attachment points 18, which are arranged on each side of the respective strap 11. This arrangement may allow the multiple pieces guiding elements 12*aa*-12*ad* are arranged on top of the supporting layer 17 or underneath the supporting layer 17.

Figure 2C:
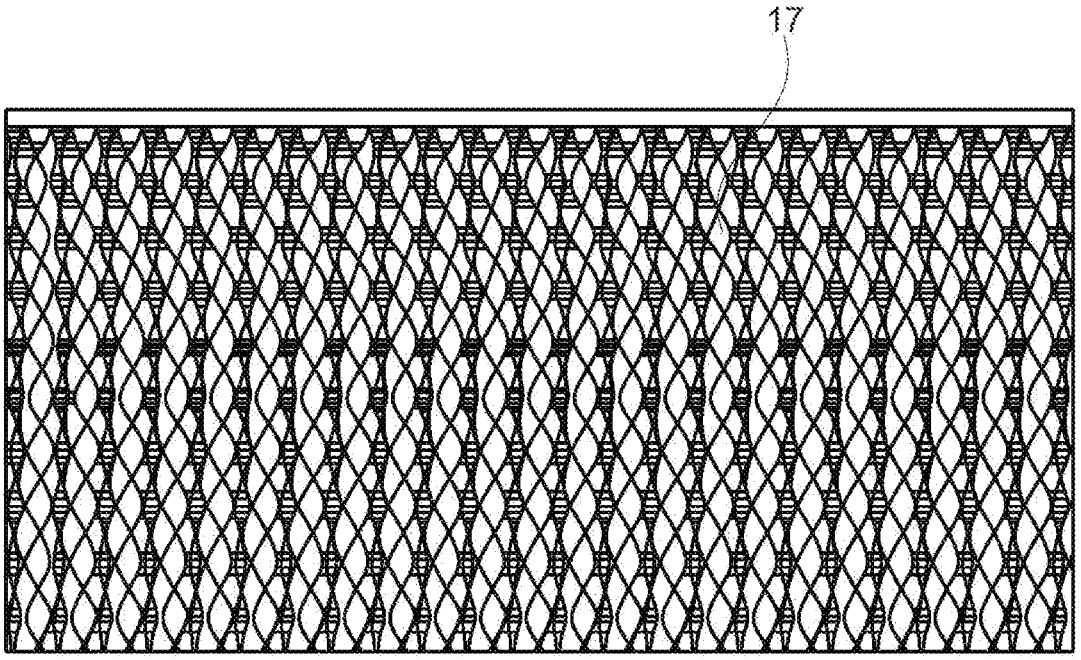

FIG. 2C shows a detailed view of a preferable material which may be used as a supporting layer 17. FIG. 2C relates to a mesh-like supporting layer 17. However, any other suitable material may also be used as a supporting layer 17.

Figure 3:
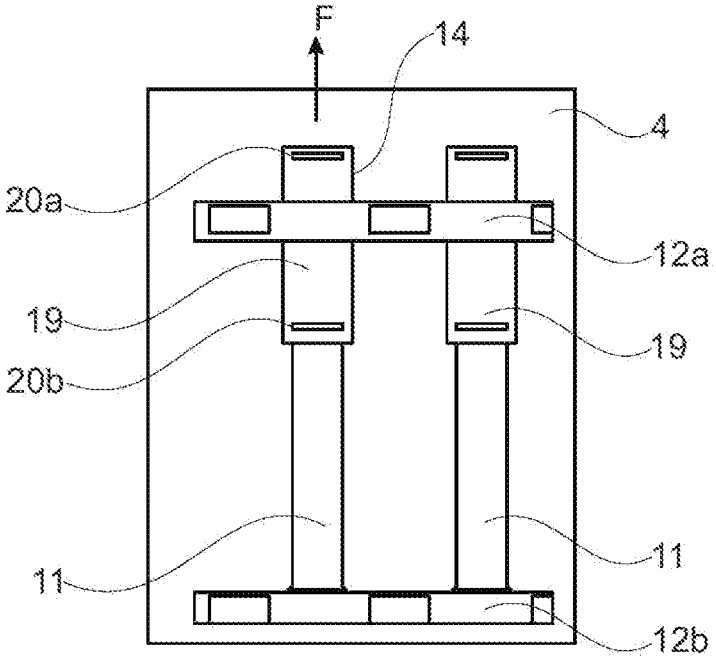
FIG. 3: an illustration of a second embodiment of a lacing system for a shoe upper according to the present invention.

FIG. 3 shows a second embodiment of the lacing system for a shoe upper according to the present invention. This embodiment differs from the first embodiment in that, the lacing system 10 further comprises an elastic element 19, which is partially attached to the strap 11. In the example of FIG. 3, the elastic element 19 is preferably attached to the strap 11 in an area which is closer to the second end 14 of the strap 11, at the throat area 4 of the shoe upper 2, than it is to the sole area 9, by two attachment points 20*a*, 20*b*, e.g., by stitching, such as a stitch line, or any other adequate attachment technique. Alternatively, the elastic element 19 may also be attached to the strap 11 at other locations of the strap 11, e.g. near the first end 13 of the strap 11.

In a typical scenario for using the lacing system by pulling a shoelace 15, received by the second end 14 of the shoe upper, and accordingly tightening the shoe upper 2, the strap 11 and the attached elastic element 19 would together be pulled up by the shoelace 15. Accordingly, the strap 11 moves along a longitudinal direction relative to the shoe upper 2, which is substantially perpendicular to the guiding elements 12*a*, 12*b* and along a longest dimension of the strap 11. The elastic element 19 generates and provides an additional restoring force, which brings a further tightening effect of the lacing system 10 to the shoe upper 2. In particular, when tightening the shoelace, the elastic element 19 is stretched and the tongue portion 6 connected to the first end 13 of the strap 11 (not shown in FIG. 3) is pulled towards the foot of the wearer.

When the shoelace received by the first end 13 of the strap 11 is untightened or partially released from a tightened state, the elastic element 19 returns to its original state but is still capable of maintaining a certain pulling force. This is due to the restoring force of the elastic element 19, which acts on the tongue portion 6 and prevents or at least decreases a slippage of the tongue portion 6. In addition, an undesired movement of the shoe upper 2 relative to the foot of the wearer can be prevented or at least reduced. Both the strap 11 and the elastic element 19 may be movable relative to the guiding elements 12*a*, 12*b* and to the shoe upper 2.

Similar to the first embodiment shown in FIGS. 2A and 2B, the guiding elements 12*a*, 12*b* may be formed as band elements or any other suitable elements which may prevent a, predominantly, lateral movement of the strap 11 and the elastic element 19. The guiding elements 12*a*, 12*b* may be formed such that they form an opening through which the elastic element 19 and/or the strap 11 may pass. The elastic element 19 may be a single layer of elastic material or may form a tube sur-rounding the strap 11. The elastic element 19 may also be arranged such that it comprises two or more layers of elastic material which are attached to each other along its' longitudinal direction. The elastic element 19 may additionally be attached to the shoe upper 2 at one or more locations. Even though the description above relates to a single strap 11 and a single elastic element 19, it should be noted that a lacing system according to the present invention may comprise a plurality of straps and a plurality of corresponding elastic elements as depicted in FIG. 3.

Figure 4:
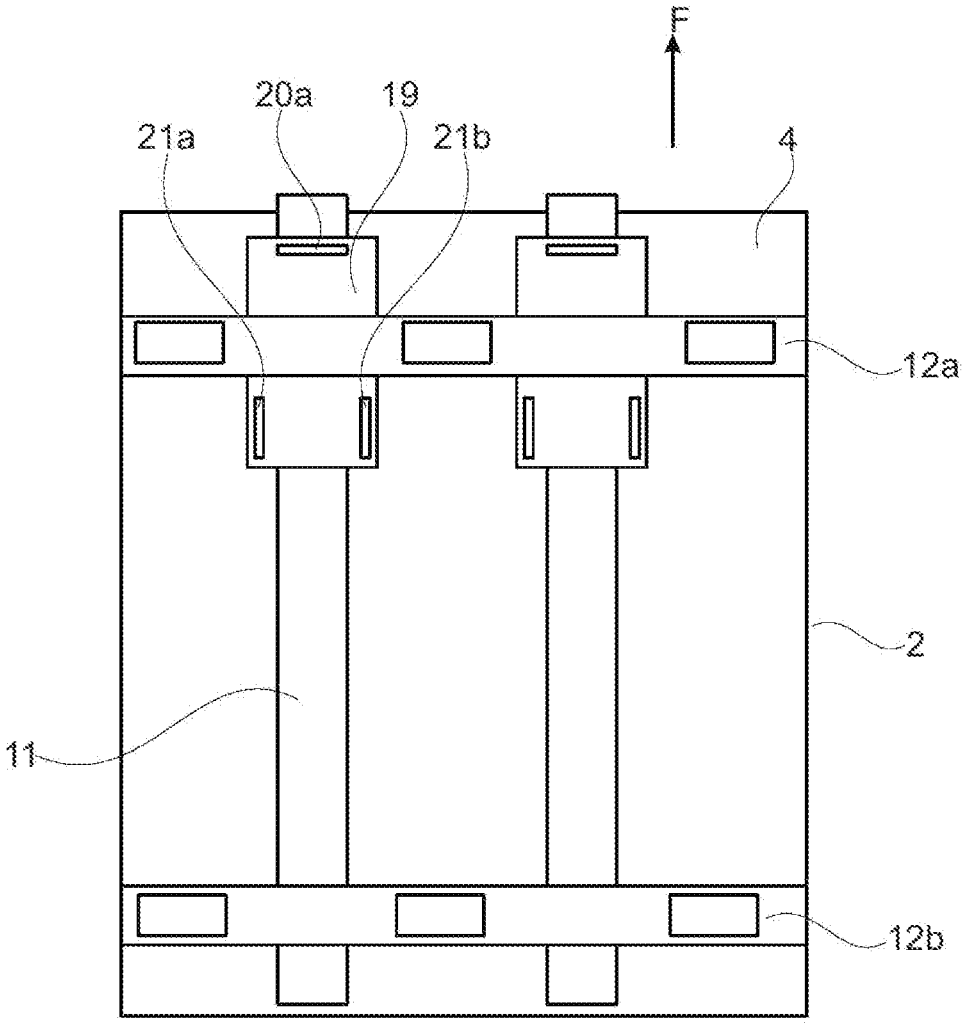
FIG. 4: an illustration of a third embodiment of a lacing system for a shoe upper according to the present invention.

FIG. 4. shows a third embodiment of a lacing system for tightening a shoe upper according to the present invention. In this embodiment, the elastic element 19 is at least partially attached to the strap 11, e.g., by stitching or any other suitable technique, and additionally partially attached to the shoe upper 2. As shown exemplarily in FIG. 4, the elastic element 19 is attached to the strap 11 at a first attachment point 20*a* and to the shoe upper 2 at attachment points 21*a*, 21*b*. The attachment may be done by stitching, such as a stitch line, or any other suitable techniques. The first attachment point 20*a* of the elastic element 19 to the strap 11 is closer to the throat area 4 than the attachment points 21*a*, 21*b* of the elastic element 19 to the shoe upper 2.

The elastic element 19 may be attached to the strap 11 at one attachment point as illustrated in FIG. 4, at two attachment points as illustrated in FIG. 3, or at more attachment points according to the requirements of the respective application of the shoe. More attachment points allow a stronger connection between the elastic element 19 and the strap 11, which can reduce the chance of damage of the lacing system. The location of the attachments can be arbitrarily chosen according to respective requirements. For example, the attachment can be oriented along a longitudinal direction of the strap 11 or any other direction.

The restoring force, which occurs due to the stretch of the elastic element 19, may be controlled by the dimension and properties of the attachment between the elastic element 19 and the shoe upper 2. The restoring force is larger when the attachment is stronger. For example, an attachment comprises a higher amount of stitches and/or a longer length of the stitches, which means a firmer connection between the shoe upper 2 and the elastic element 19, results in a larger restoring force.

Figure 5A:
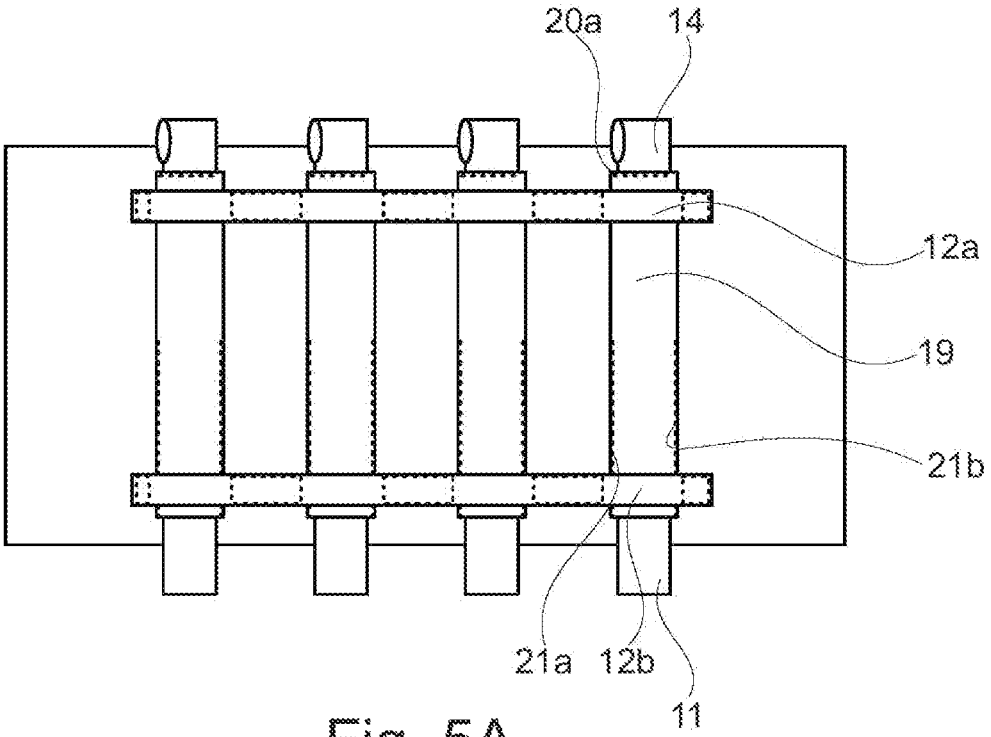
FIG. 5A-D: an illustration of a fourth embodiment of a lacing system for a shoe upper according to the present invention.

FIG. 5A shows a fourth embodiment of a lacing system for tightening a shoe upper according to the present invention. The elastic element 19 in this embodiment extends from the first guiding element 12*a* to the second guiding element 12*b* of the lacing system. Each of the guiding elements 12*a*, 12*b* is arranged as a band element and forms an opening through which the strap 11 and the elastic element 19 pass. The elastic element 19 is wider than the strap 11 and covers the segment of the strap 11 between the first and second guiding elements for a better protection of the strap 11. In principle, the elastic element 19 is arranged such that it forms a tube in which the strap 11 is located.

The attachments of the elastic element 19 to the strap 11 and to the shoe upper 2 are similar to the ones described in the third embodiment (FIG. 4). The elastic element 19 is attached to the strap 11 at one attachment point 20*a* near the second end 14 of the strap 11. The elastic element 19 is attached to the shoe upper 2 at two attachment points 21*a*, 21*b*, however in this embodiment at a location closer to the second guiding element 12*b*. The attachments can be fulfilled by stitching, such as a stitch line, or any other suitable techniques. As the elastic element 19 in this embodiment is bigger, the attachments may comprise a higher amount of the stiches or a longer length of stitches. In case multiple straps 11 are used, each of the straps 11 passes through a corresponding elastic element 19 as shown in FIG. 5A.

Figure 5B:
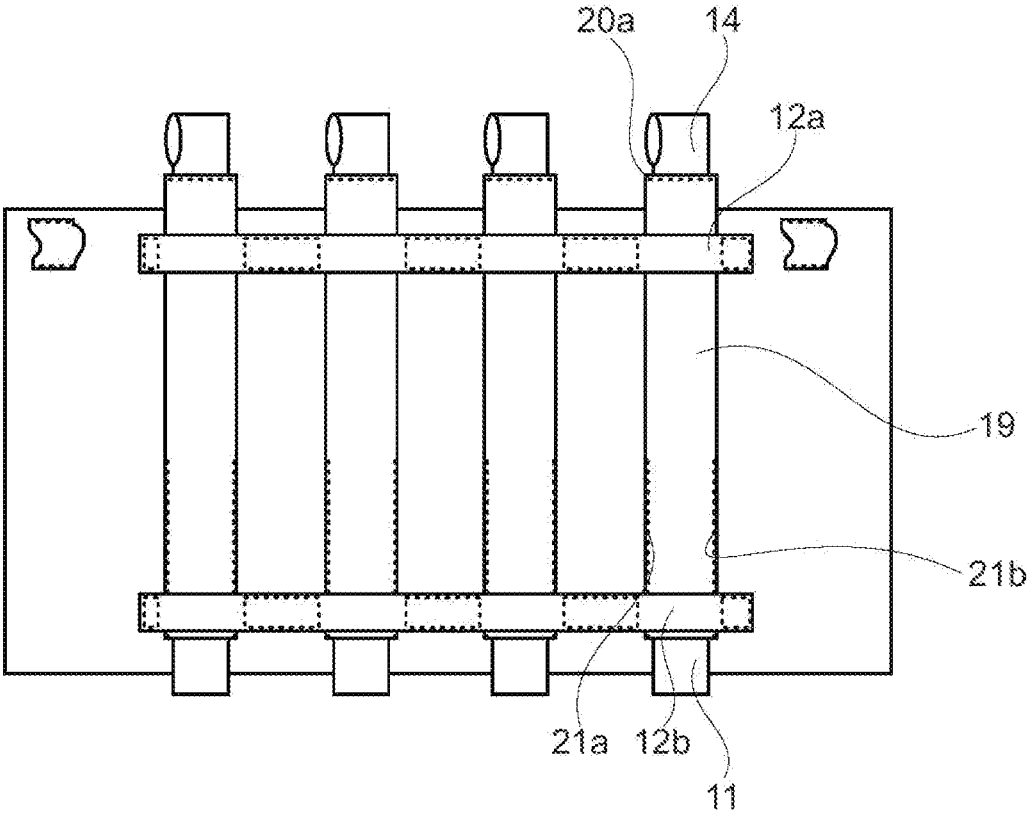

5A shows the lacing system in a relaxed state, i.e. a situation at which the shoe-lace 15 is not tightened, while FIG. 5B shows exemplarily the lacing system in a tightened state. As a result of tightening the shoelace 15 which is received by the second end 14 of the strap 11, the elastic element 19 is stretched along its longitudinal direction and towards the throat opening 5*a*. The elastic element 19 and the strap 11, which is attached to the elastic element e.g. by stitching at an attachment point 20*a* and further attachment points 21*a* and 21*b*, are allowed to move freely relative to the guiding elements 12*a* and 12*b*.

Figure 5C:
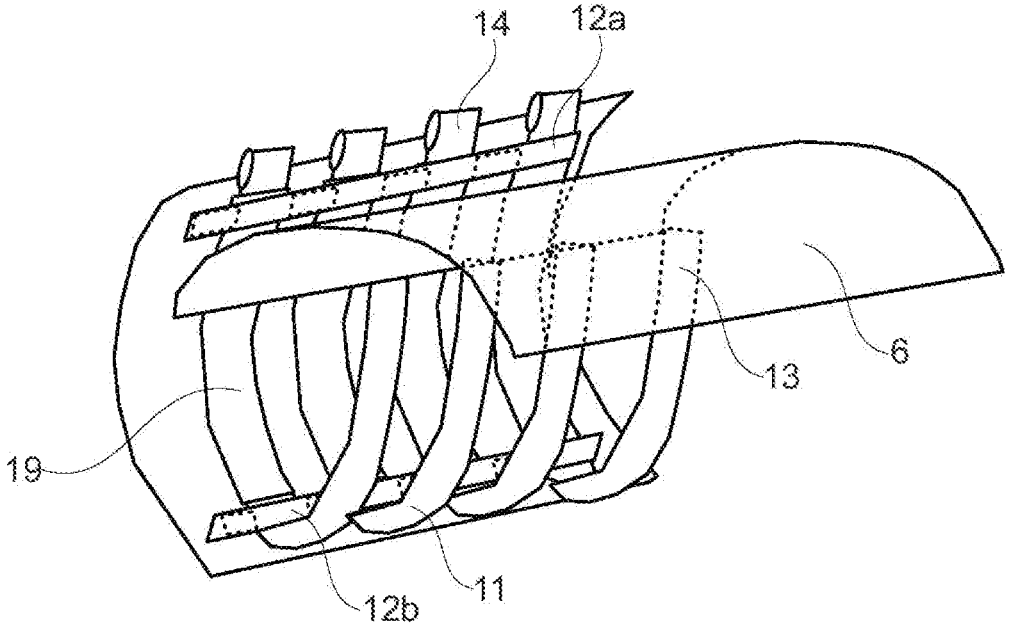
Figure 5D:
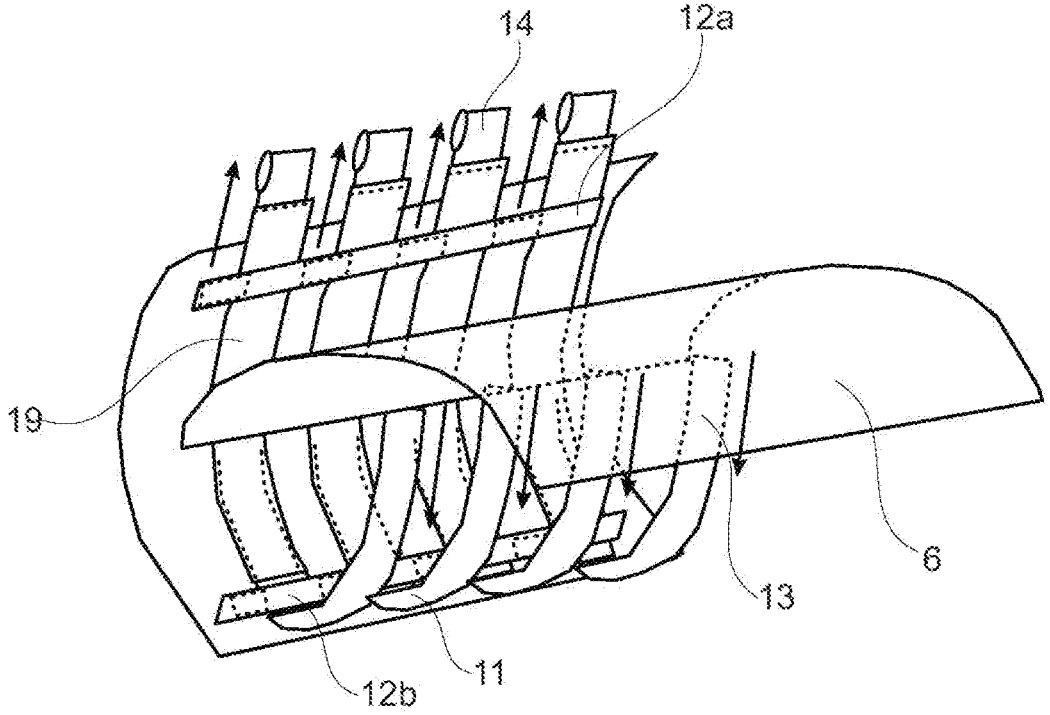

Analogously to FIGS. 5A and 5B, which show the lacing system in a relaxed (FIG. 5A) and a tightened (FIG. 5B) state, FIGS. 5C and 5D illustrate the effect of tightening the lacing system on a tongue portion 6 of the shoe upper. FIG. 5C shows the lacing system in a relaxed, i.e. an untightened state. As outlined above, e.g. for FIGS. 5A and 5B, the strap 11 is attached to an elastic element 19. The second end 14 of the strap 11 is formed to receive a shoelace 15. Guiding elements 12*a* and 12*b* are used to prevent any lateral movement of the strap 11 and the elastic element 19. The first end 13 of the strap 11 is attached to the tongue portion 6. As a result of tightening the shoelace 15, i.e. pulling on the strap 11 and the elastic element 19, the second end 14 of the strap 11 is pulled upwards towards the throat opening 5*a*. Consequently, the first end 13 of the strap 11 is pulled downwards towards the sole area 9 of the shoe upper 2. Since the first end 13 of the strap 11 is attached to the tongue portion 6, the tongue portion 6 is also pulled downwards towards the sole area 9 of the shoe upper 2. As a result of pulling the tongue portion 6 downwards, the tongue portion 6 wraps around the foot of a wearer and provides additional immobilization of the foot of the wearer.

Figure 6:
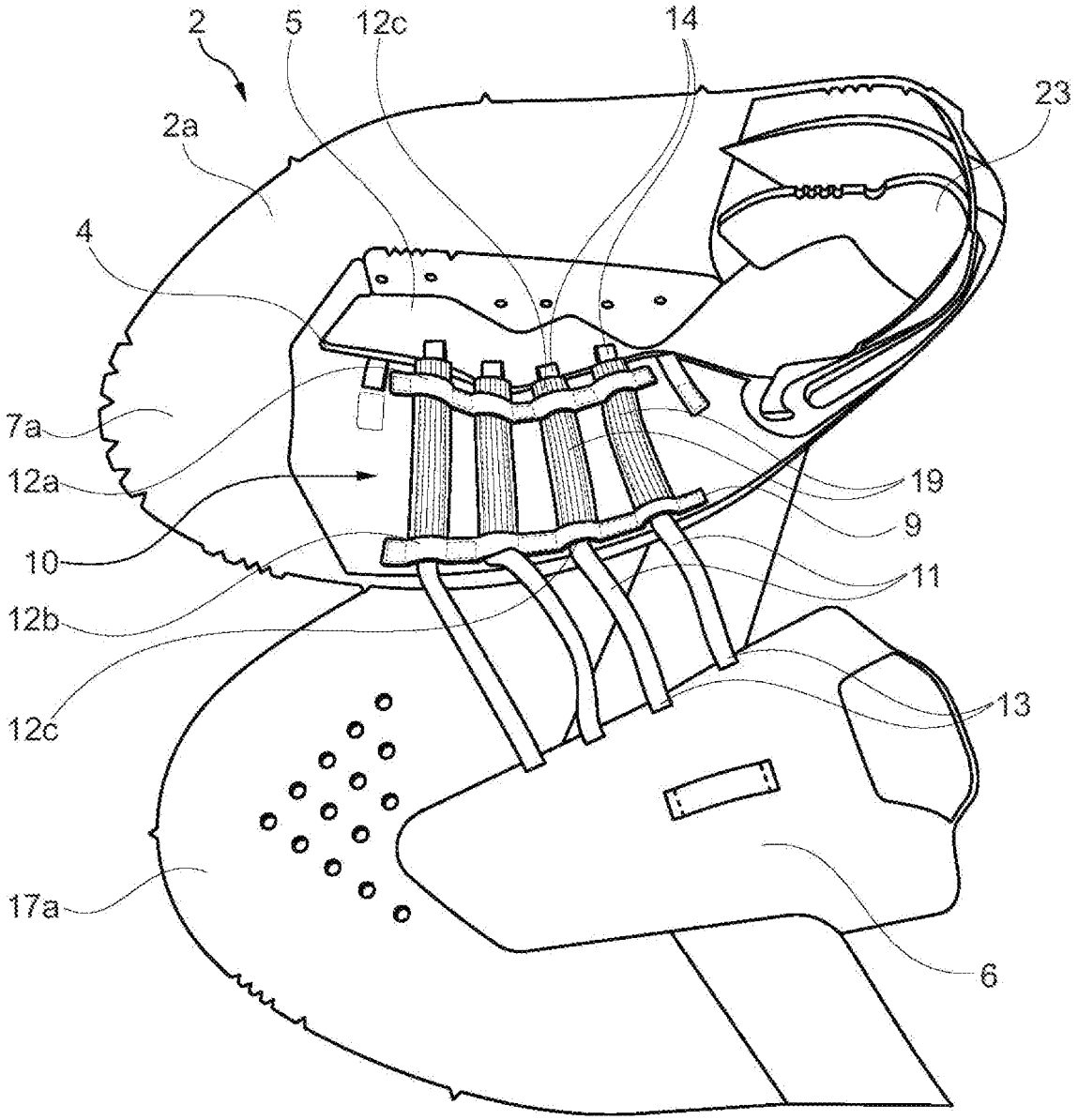
FIG. 6: an exemplary disassembled shoe upper prototype with a lacing system according to the fourth embodiment of the present invention.

FIG. 6 shows an exemplary shoe upper prototype comprising the fourth embodiment of the lacing system as schematically shown in FIG. 5A. The shoe upper 2 is disassembled for the purpose of a clearer explanation herein. The shoe upper 2 comprises a main body 2*a* and a tongue portion 6 which is connected to a supporting layer 17*a*. The tongue portion 6 would be visible from a top view of the shoe upper 2 when it is worn by a wearer. Referring to FIG. 1, the shoe upper 2 comprises a throat area 4, a sole area 9 and a heel portion 23. The throat area 4 comprises a throat opening 5*a*.

The lacing system 10 comprises multiple straps 11, a first guiding element 12*a*, a second guiding element 12*b* and multiple elastic elements 19 corresponding to the straps 11. The straps 11 attach to the tongue portion 6 at their first ends 13 and form a loop to receive at least a part of a shoelace (not shown) at their second ends 14. The first guiding element 12*a* is arranged in the throat area 4 of the shoe upper 2, and the second guiding element 12*b* is arranged in the sole area 9 of the shoe upper 2 opposite to the throat area 4. In between the first guiding element 12*a* and the second guiding element 12*b*, the elastic element 19 is located. The straps 11 are arranged within the elastic elements 19 and protrudes from an opening of the elastic element 19 at the throat area 4.

The guiding elements 12*a*, 12*b* are arranged such that they form openings 12*c* in between the inner side 7*a* of the shoe upper 2 and the guiding elements 12*a*, 12*b*. In this embodiment, each of the guiding elements 12*a*, 12*b* is a band element forming multiple openings 12*c* to receive the multiple straps 11 and the corresponding elastic elements 19.

Each of the elastic elements 19 also passes through a corresponding opening 12*c* as the straps 11. The elastic element 19 and the straps 11 are therefore constrained to a width of the opening with respect to any lateral movement. Moreover, the opening 12*c* further prevents or at least decreases displacements which may occur during wearing the shoe upper 2.

The straps 11 are arranged between the elastic elements 19 and the inner side 7*a* of the shoe upper 2. Accordingly, the straps 11 are covered by the elastic elements 19 or are within the elastic elements 19 and are not in contact with the foot of a wearer when the shoe upper is worn. When the shoe upper 2 is assembled to be worn, the supporting layer 17 is arranged to be between the foot of a wear and the lacing system 10, which can avoid any undesired contact of the supporting layer 17 and the lacing system 10 and it may avoid unpleasant pressure points on the instep of the foot of the wearer. Therefore, a shoe upper 2 having the lacing system 10 according to the present invention can still provide optimized comfort to the foot of the wearer, while it promises a customized fitting and a lock-down effect as a result of tensioning the lacing system 10. The supporting layer can be a mesh layer made of mesh material or a padding layer providing cushioning effects.

In this exemplary shoe upper prototype as shown in FIG. 6, the lacing system 10 is arranged at an inner side 7*a* of the shoe upper 2, which is therefore not visible when the shoe upper 2 is worn by a wearer. However, the lacing system 10 may also be arranged at an outer side of the shoe upper 2. In this case, the first end 13 of the straps 11 connecting to the tongue portion 6 would remain at the inner side of the shoe upper, while the guiding elements 12*a*, 12*b* and the elastic elements 19 would be arranged at an outer side of the shoe upper 2.

In all potential embodiments, it is possible that the lacing system according to the present invention is equipped with more than one strap 11 and corresponding elastic elements 19. In all potential embodiments, an additional supporting layer may be provided and configured to cover at least partially the straps and/or the guiding elements and/or the elastic element.

Figure 7A:
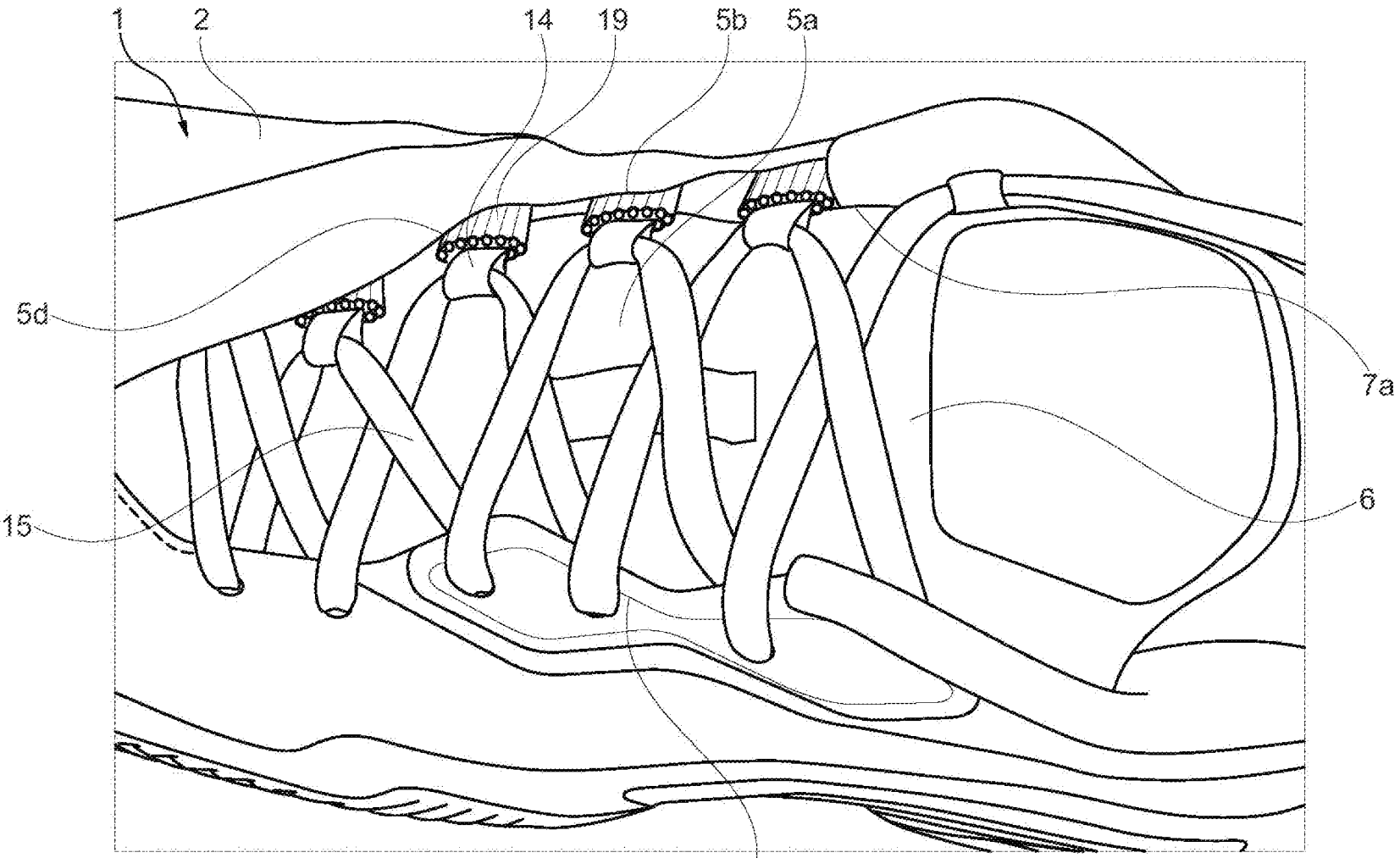
FIG. 7A-C: a shoe with a lacing system according to the fourth embodiment of the present invention.
Figure 7B:
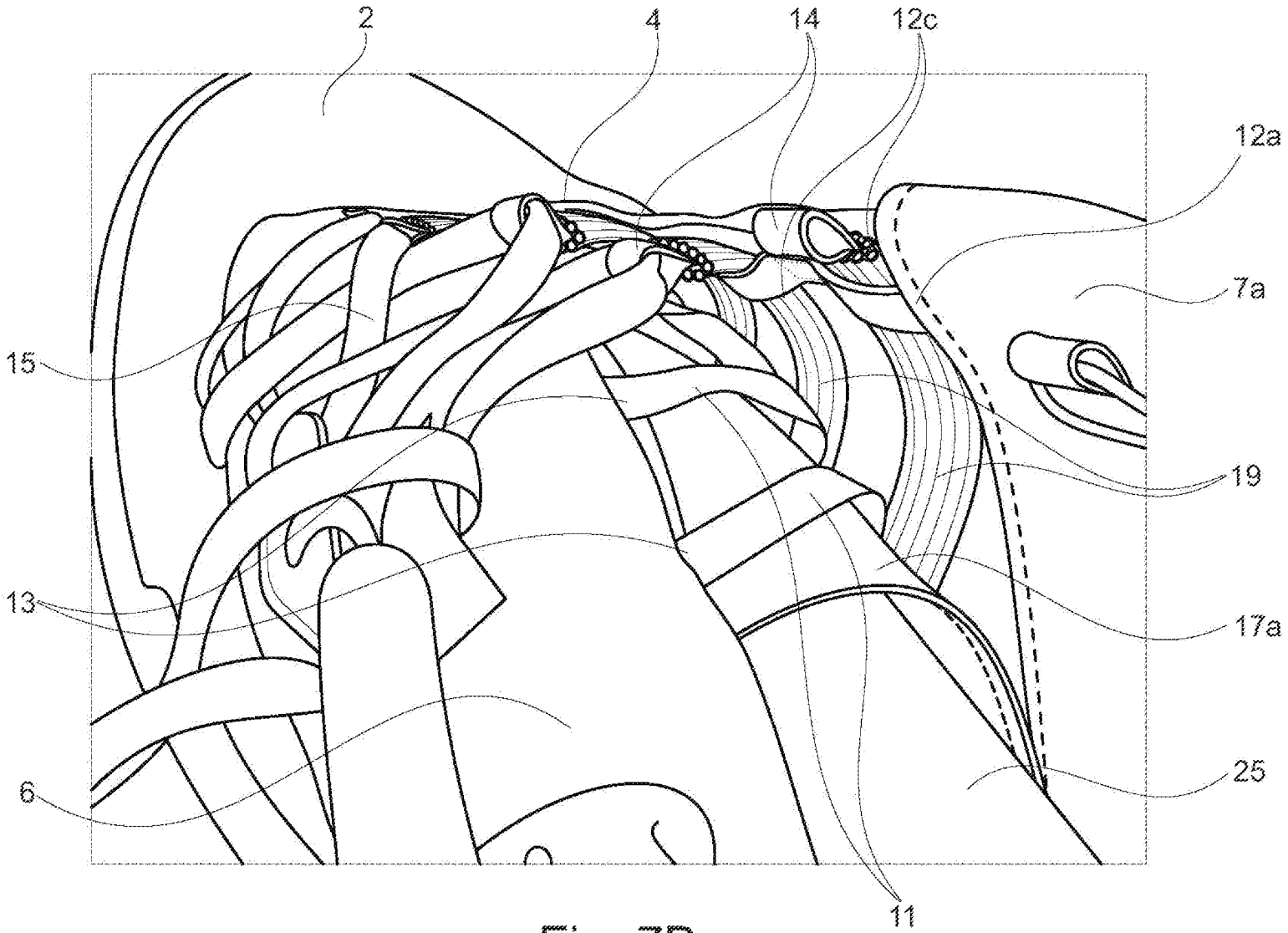
Figure 7C:
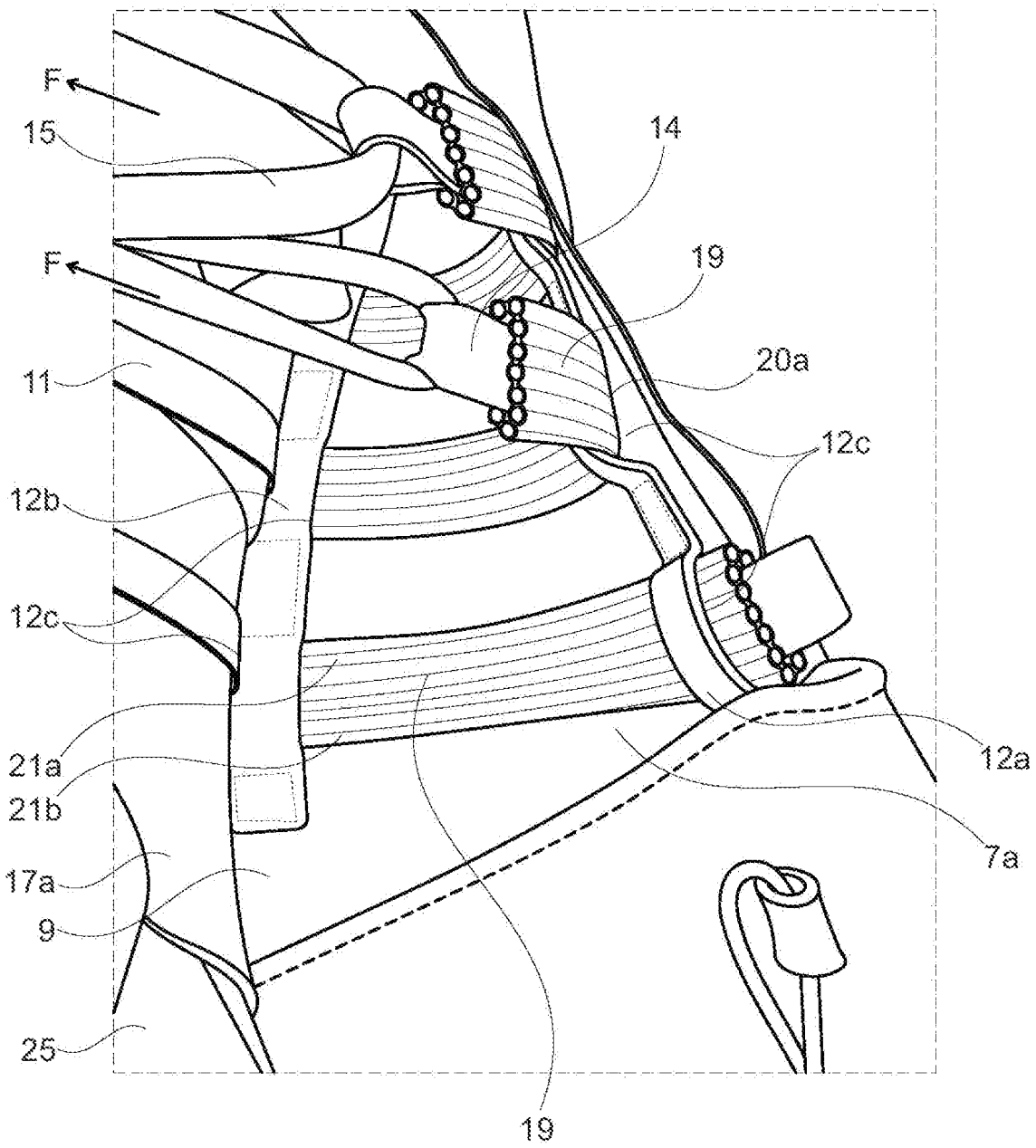

FIGS. 7A-7C show a shoe 1 with a lacing system 10 according to the fourth embodiment of the present invention which was described with reference to FIGS. 5 and 6.

FIG. 7A shows a top view of the shoe, which comprises a shoe upper 2. The shoe upper 2 comprises a throat opening 5*a*, which is surrounded by two opposite throat sides 5*b*, 5*c*. A tongue portion 6 of the shoe upper 2 is located at the throat opening 5*a*, in particularly beneath the two throat sides 5*b*, 5*c*.

In this exemplary shoe, the lacing system is arranged at the inner side 7*a* of the shoe upper and only on the medial side, i.e. the throat side 5*b*, of the shoe upper 2. The lacing system comprises four visible straps from the top view, each of which having a second end 14 formed as a loop to receive the shoelace 15. The second ends 14 of the straps 11 extend from a throat edge 5*d* of the shoe upper. The lacing system further comprises four elastic elements 19 each corresponding to a strap 11. Alternatively, the lacing system may have straps arranged on both lateral and medial sides of the shoe upper, i.e., both throat sides 5*b*, 5*c*.

The number and dimensions of the straps 11 and the corresponding elastic elements 19 of the lacing system are flexible and can be affected and designed based on different requirements, e.g., the size and/or the material of the shoe upper, the shape of a foot of a wearer, the particular sports application the shoe is de-signed for, the construction of the shoe, etc.

FIG. 7B shows a closer view of the lacing system according to the fourth embodiment of the present invention from an inner side 7*a* of the shoe 1 as shown in FIG. 7A. The closer view is shown as a view from a heel portion towards a toe portion of the shoe upper 2 along the tongue portion 6. The toe portion is located at the opposite side of the heel portion 23 of the shoe upper 2 with respect to the longitudinal direction of the shoe upper 2.

It can be clearly seen in FIG. 7B that the second end 14 of the strap 11 is arranged as a loop to receive the shoelace 15. Alternatively or additionally, the strap can have a hole punched inside to create a lace loop. Other loops can be stitched onto the strap. The first end 13 of the strap 11 is attached to the tongue portion 6.

A first guiding element 12*a* of the lacing system is arranged in the throat area 4 of the shoe upper 2 and forms openings 12*c* through which the straps 11 pass. The straps 11 are freely movable with respect to the openings and the shoe upper 2. A second guiding element 12*b* is arranged in a sole area of the shoe upper, which cannot be seen in FIG. 7B as being hidden behind a supporting layer 17*a* but is shown in FIG. 7C. The straps 11 are guided by the first and second guiding elements 12*a*, 12*b* from the throat area 4 along the inner side 7*a* of the shoe upper 2 and towards an insole 25 of the shoe upper 2, which is arranged near the sole area of the shoe upper. The second guiding element 12*b* defines a reversal point from which the straps 11 run upwards towards the tongue portion 6 where the straps 11 are attached thereto at their first ends 13.

Each of the straps 11 is attached to an elastic element 19, which is accordingly attached to the inner side 7*a* of the shoe upper 2, by stitching, such as a stitch line, or any other suitable technique. In this embodiment, the elastic element 19 is formed as an elastic tube in which the strap 11 is located.

FIG. 7C shows a more detailed view of the lacing system shown in FIGS. 7A-7B, particularly the arrangement in the space between the inner side 7*a* of the shoe upper 2 and the supporting layer 17*a*. The second guiding element 12*b* is arranged at the sole area 9 of the shoe upper 2, and similar to the first guiding element 12*a*, forms openings 12*c* through which the straps 11 pass.

Each of the straps 11 is attached to a corresponding elastic tube 19 at one or more locations. In this embodiment, the strap 11 is attached to the elastic tube 19 at one attachment point 20*a* near its second end 14, for example, by stitching. Except the direct attachment to the elastic tube 19 and the attachment to the tongue portion 6 at its first ends 13, the straps 11 are neither attached to the guiding elements 12*a*, 12*b* nor to the shoe upper 2, therefore is freely movable with respect to the shoe upper 2.

The elastic tube 19 is further attached to the shoe upper 2 at two attachment points 21*a*, 21*b* at opposite sides of the elastic tube 19 by stitching. The length and amounts of the stitches are flexible. In this embodiment, the length of the stitch connecting the elastic tube 19 and the shoe upper 2 is longer than half of the length of the elastic tube 19 and therefore provides a strong and stable attachment of the elastic tube 19 and the shoe upper 2.

When a shoe wearer pulls up the shoelace 15 received by the second end 14 of the strap 11, in a direction away from the instep of the foot of a wearer, the pulling force F acts on the strap 11 and the elastic tube 19 and is correspondingly transferred to the tongue portion 6 via the strap 11. The segment of the strap 11 positioned between the second end 14 and the second guiding element 12*b* is pulled up towards the same direction as the force F. Given that the second guiding element 12*b* functions as a reversal point for the movement of the strap 11, the other segment of the strap 11 positioned between the first end 13 and the second guiding element 12 is contrarily pulled down in a direction towards the instep of the foot of a wearer. Accordingly, the tongue portion 6 is also pulled down towards the instep of the foot, which results in the desired tightening and lock-down effect of the shoe upper 2 with respect to the foot of a wearer.

Moreover, when the shoelace 15 is tightened, the elastic tube 19 is pulled upwards together with the strap 11 in a direction away from the instep of a foot of the wearer. The elastic tube 19 and the strap 11 are therefore in a stretched state, which provides additional immobilization for the foot of the wearer as a result of the restoring force provided by the elastic tube 19. Once the shoelace 15 is un-tightened or released, either on purpose or unintentionally, the tightened shoe upper 2 (including the tongue portion 6 and the supporting layer 17*a*) wrapping the foot of a wearer remains its location and the optimized fitting and lock-down effect on the foot is maintained. This is particularly advantageous and beneficial for an athlete during a sports activity, where the shoe upper 2 can always remain fit to the foot of the athlete even when the shoelace is undesirably untightened.

In this embodiment, the supporting layer 17*a* is connected to the tongue portion 6 and can be considered as an extension of the tongue portion 6 such that the tightening effect is extended and distributed to a larger area of the shoe upper 2. The supporting layer 17*a* is located between the shoe upper 2 and the foot of the wearer, therefore separates the foot of the wearer from the lacing system and the straps 11. When the shoelace is pulled and the shoe upper 2 is tightened, the supporting layer 17*a* wraps the foot of the wearer in combination with the insole 25. A flat supporting layer and/or a supporting layer 17*a* with padding materials can provide more comfort to the foot of the wear, because the tightening pressure located on the individual pulled straps 11 can be more evenly distributed.

Figure 8:
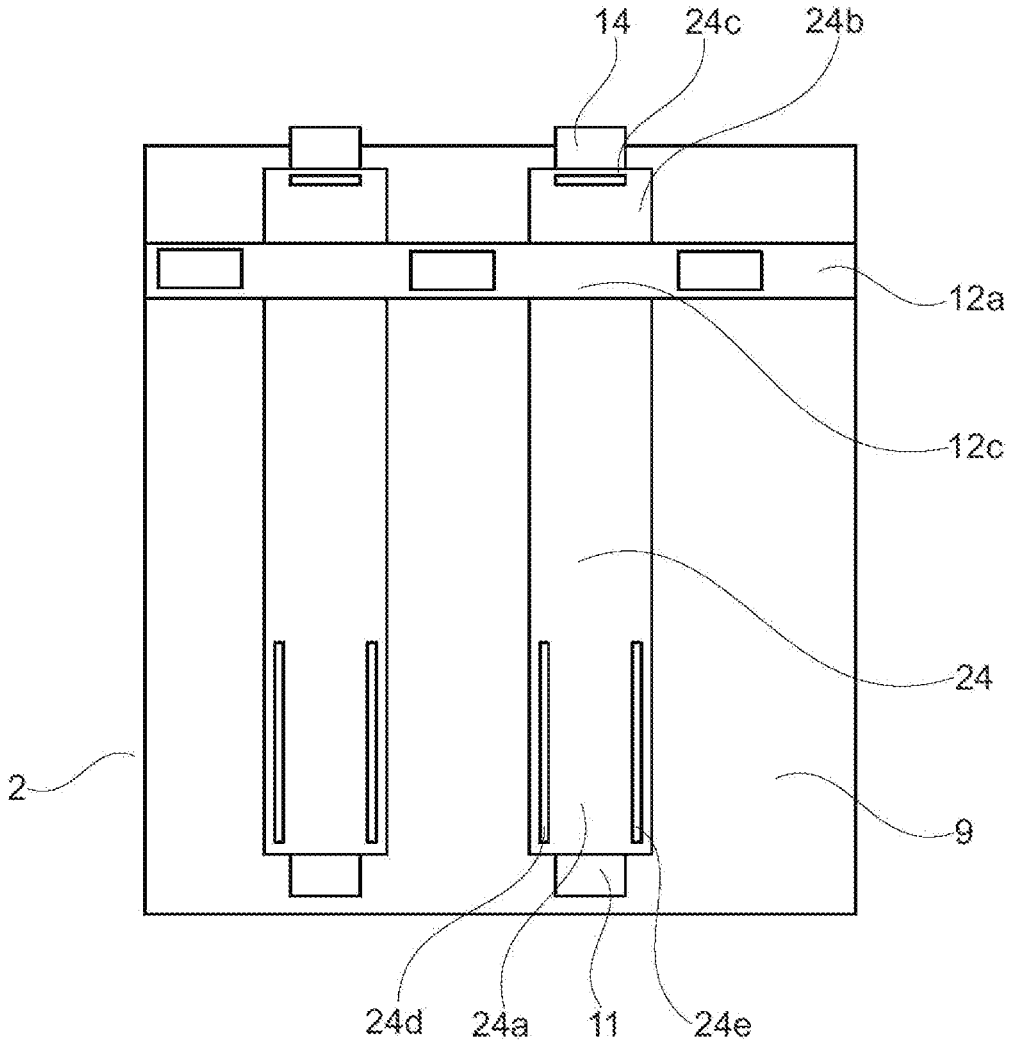
FIG. 8: an illustration of a fifth embodiment of a lacing system for a shoe upper according to the present invention.

FIG. 8 shows a fifth embodiment of a lacing system for tightening a shoe upper 2 according to the present invention. This embodiment differs from the previous embodiments in that the lacing system 10 comprises only the first guiding element 12*a* and not the second guiding element 12*b* and the lacing system 10 further comprises a multifunctional element 24. The multifunctional element 24 has a first end 24*a* located in the sole area 9 of the shoe upper 2 and a second end 24*b* located in the throat area 4 of the shoe upper 2. The multifunctional element 24 forms a tube from the sole area 9 to the throat area 4 of the shoe upper 2. The strap 11 passes through the tube formed by the multifunctional element 24.

The second end 24*b* of the multifunctional element 24 is attached to the strap 11 at an attachment point 24*c* near the second end 14 of the strap 11. The attachment point 24*c* is optionally oriented transverse to a longitudinal direction of the strap 11, i.e. parallel to the guiding element 12*a* and substantially perpendicular to the longitudinal direction of the strap 11. The attachment can be done by stitching, such as a stitch line, or any other suitable technique.

It is preferred that the multifunctional element 24 comprises an elastic material at least on its second end 24*b*. The second end 24*b* of the multifunctional element 24, which connects with the strap 11 at its second ends 14, passes through the openings 12*c* of the first guiding element 12*a* and is freely movable with respect to the first guiding element 12*a* and the shoe upper 2. When a shoelace received by the second end 14 of the strap 11 is pulled, the second end 24*b* of the multifunctional element 24 would be pulled as well, therefore providing an elastic function with a restoring force similar to the function of the elastic element 19 as described in the previous embodiments.

The first end 24*a* of the multifunctional element 24 is attached to the shoe upper 2 in the sole area 9, e.g., by stitching, such as a stitch line, or any other suitable techniques. In this embodiment, the multifunctional element 24 is attached to the shoe upper 2 at two attachment points 24*d*, 24*e*, which are oriented vertically along the longitudinal direction of the strap 11. The first end 24*a* of the multifunctional element 24 is therefore essentially not movable relative to the shoe upper. These attachment points 24*d*, 24*e* limit the lateral movement of the strap 11 located in the tube of the multifunctional element 24 in the sole area 9 of the shoe upper. Accordingly, the multifunctional element 24 is provided partially as a guiding element for the strap 11 in the sole area 9 of the shoe upper 2.

In other words, for the lacing system in this embodiment, the multifunctional element 24 functions as a guiding element at its first end 24*a* and as an elastic element at its second end 24*b*. This implementation simplifies the structure of the lacing system and accordingly reduces the dimension (e.g., thickness) and weight of the lacing system. A lighter shoe upper with the same optimized fit and comfort provided by the lacing system can thus be provided.

It is preferable in all embodiments, as described above, that if a second end 14 of the strap 11 is moved upwards in an opposite direction of the instep of a foot of the wearer, it automatically causes the first end 13 of the strap 11 to move down-wards and thus accordingly causes the tongue portion 6 to move downwards towards the foot of the wearer. This may allow for a 360-degree midfoot lock and fit. The strap 11 may only move by such an amount as the foot of the wearer al-lows. A narrow foot will thus allow the strap 11 to move further than a wider foot. Consequently, a better fit of the shoe upper and the shoe may be provided com-pared to the prior art. As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

What is claimed is:

1. A shoe comprising:

a sole;

a shoe upper positioned above the sole and having a tongue portion, a throat area and a sole area adjacent the sole;

a lacing system comprising:

a plurality of straps, each having a first end and a second end, wherein for each of the plurality of straps, the first end is attached to the tongue portion of the shoe upper and the second end is configured to receive a portion of a shoelace;

a first guiding element and a second guiding element each positioned along an inner side of the shoe upper, the first and second guiding elements each coupling the plurality of straps to the inner side of the shoe upper, wherein the first guiding element is arranged in the throat area of the shoe upper adjacent the second end of each of the plurality of straps, and the second guiding element is arranged in the sole area of the shoe upper, opposite to the throat area; and a plurality of elastic elements, where each elastic element is attached to one of the plurality of straps and each elastic element extends from the first guiding element to the second guiding element, wherein each elastic element is stretchable along a longitudinal direction of each strap, wherein tightening the shoelace pulls the second end of each of the plurality of straps towards a throat opening, thereby pulling the first end of each strap and the tongue portion towards the sole area of the shoe upper so the tongue portion wraps around a foot of a wearer and is configured to provide immobilization of the foot of the wearer.

2. The shoe of claim 1, wherein the plurality of straps comprises at least three straps movable relative to the shoe upper.

3. The shoe of claim 1, wherein the first guiding element and the second guiding element are attached to the shoe upper.

4. The shoe of claim 3, wherein the first guiding element and/or the second guiding element is a band element attached to the shoe upper along a portion to form an opening, and wherein one of the plurality of straps passes through the opening.

5. The shoe of claim 1, wherein the first guiding element and/or the second guiding element is a band element which is attached to the shoe upper along a portion to form an opening, and wherein one of the plurality of straps and one of the plurality of elastic elements pass through the opening.

6. The shoe of claim 1, wherein each elastic element is attached to the shoe upper having a first attachment point of each elastic element to one of the plurality of straps that is closer to the throat area of the shoe upper than a second attachment point of each elastic element to the shoe upper.

7. The shoe of claim 1, wherein each elastic element is arranged between one of the plurality of straps and one of the first and second guiding elements and/or between one of the plurality of straps and the shoe upper.

8. The shoe of claim 6, wherein each elastic element extends from the first guiding element to the second guiding element.

9. The shoe of claim 6, wherein each elastic element has a width larger than a width of one of the plurality of straps.

10. The shoe of claim 1, wherein each elastic element forms a tube, and wherein one of the plurality of straps passes through each tube.

11. The shoe of claim 1, further comprising a supporting layer covering at least partially the plurality of straps and/or the first and second guiding elements and/or the plurality of elastic elements.

12. The shoe of claim 1, wherein the second end of each strap forms a loop.

13. The shoe claim 1, wherein the lacing system is arranged on a quarter area and/or a midfoot area of the shoe upper with the first end of each strap attached to the tongue portion of the shoe upper by stitches and as a result of tightening the shoelace received by the second end of each strap, each strap is configured to pull the tongue portion of the shoe upper towards the foot of the wearer.

14. The shoe of claim 1, wherein the plurality of straps is positioned on a first side of the throat area.

15. The shoe of claim 14, wherein the first guiding element and/or the second guiding element is a one-piece band element attached to the shoe upper to form a plurality of openings, and wherein each of the plurality of straps passes through a corresponding opening.

16. A shoe comprising:

a sole;

a shoe upper positioned above the sole, the shoe upper comprising:

a throat opening defined by a first throat side and a second throat side;

a tongue portion positioned at least partially between the first and second throat sides;

a sole area adjacent the sole and below a throat area and the tongue portion;

a lacing system arranged on an inner side of the shoe upper which is configured to contact with a foot of a wearer, the lacing system comprising:

a strap having a first end attached to the tongue portion of the shoe upper and extending along the inner side of the shoe upper to a second end of the strap positioned along the throat opening and configured to receive a portion of a shoelace, wherein the strap is attached to the inner side of the shoe upper along the sole area;

an elastic element which is attached to at least a portion of the strap, wherein the elastic element is stretchable along a longitudinal direction of the strap; and a band attached to the inner side of the shoe upper along the throat area for guiding the second end of strap, thereby coupling the strap to the shoe upper, wherein tightening the shoelace pulls the second end of the strap towards the throat opening, thereby pulling the first end of the strap and the tongue portion towards the sole area of the shoe upper so the tongue portion is configured to wrap around the foot of the wearer.

17. The shoe of claim 16, wherein the band is attached to the shoe upper along a segment to form an opening, and wherein the strap passes through the opening.

18. The shoe of claim 16, wherein the second end of the strap forms a loop to receive the portion of the shoelace, wherein the loop extends from an edge of the throat opening along at least one of the first or second throat sides.

19. The shoe of claim 16, wherein the strap is only located on a medial side of the throat area.

20. The shoe of claim 19, wherein the band and/or the elastic element is attached to the shoe upper by stitches.

21. The shoe of claim 19, wherein the elastic element forms a tube, and wherein the strap passes through the tube.

22. The shoe of claim 21, wherein a first end of the tube is attached to the second end of the strap, and wherein a second end of the tube is attached to the shoe upper in the sole area.

23. The shoe of claim 16, wherein the strap comprises a plurality of straps, wherein the first end of each of the plurality of straps is attached to the tongue portion of the shoe upper and the second end of each of the plurality of straps positioned along the throat opening and configured to receive a portion of the shoelace.

24. A shoe comprising:

a sole;

a shoe upper positioned above the sole and having a tongue portion, a throat area and a sole area adjacent the sole;

a lacing system, the lacing system comprising:

at least two straps, each having a first end attached to the tongue portion of the shoe upper and a second end positioned along the throat area and configured to receive a portion of a shoelace, wherein the at least two straps are positioned only on a first side of the throat area; and a band attached to an inner side of the shoe upper for guiding the second end of each of the at least two straps, thereby coupling the at least two straps to the shoe upper, wherein when a wearer pulls the shoelace in an upward direction away from the sole, the shoelace pulls the at least two straps along in the upward direction, resulting in the tongue portion being moved down towards the sole and closer to the foot of the wearer thereby wrapping the shoe upper around the wearer's foot.

25. The shoe of claim 24, further comprising: at least two elastic elements each stretchable along a longitudinal direction of one of the at least two straps, where one of the at least two elastic elements is attached to one of the at least two straps.

26. The shoe of claim 24, wherein the second end of each of the at least two straps forms a loop.

27. The shoe of claim 24, further comprising a supporting layer at least partially covering the at least two straps, wherein the supporting layer is positioned along the inner side of the upper and configured to be located between the lacing system and the foot of the wearer, wherein the at least two straps are moveable relative to the supporting layer.

* * * * *